US012369632B2

(12) United States Patent
Chapman et al.

(10) Patent No.: US 12,369,632 B2
(45) Date of Patent: Jul. 29, 2025

(54) ELECTRONIC SMOKING ARTICLE WITH IMPROVED STORAGE AND TRANSPORT OF AEROSOL PRECURSOR COMPOSITIONS

(71) Applicant: RAI Strategic Holdings, Inc., Winston-Salem, NC (US)

(72) Inventors: Paul Stuart Chapman, Winston-Salem, NC (US); Yan Pu, Winston-Salem, NC (US); Timothy Brian Nestor, Advance, NC (US); Charles Jacob Novak, Winston-Salem, NC (US); Grady Lance Dooly, Winston-Salem, NC (US); Steven Floyd Nielsen, Charlotte, NC (US); Bryan Peter Thomas, York, SC (US); Alan Curtis Billings, Raleigh, NC (US)

(73) Assignee: RAI Strategic Holdings, Inc., Winston-Salem, NC (US)

( * ) Notice: Subject to any disclaimer, the term of this patent is extended or adjusted under 35 U.S.C. 154(b) by 132 days.

(21) Appl. No.: 16/421,993

(22) Filed: May 24, 2019

(65) Prior Publication Data

US 2019/0281896 A1 Sep. 19, 2019

Related U.S. Application Data

(63) Continuation of application No. 13/802,950, filed on Mar. 14, 2013, now abandoned.

(51) Int. Cl.
*A24F 40/44* (2020.01)
*A24F 40/42* (2020.01)
(Continued)

(52) U.S. Cl.
CPC ..... *A24F 40/44* (2020.01); *A24F 40/42* (2020.01); *A24F 40/70* (2020.01); *A24F 40/10* (2020.01); *D04C 1/06* (2013.01)

(58) Field of Classification Search
CPC ..... A23F 47/004; A24D 3/17; A24D 1/22; A24C 5/01; A24F 15/00; A24F 15/01;
(Continued)

(56) References Cited

U.S. PATENT DOCUMENTS 1,771,366 A 7/1930 Wyss et al.
2,057,353 A 10/1936 Whittemore, Jr.
(Continued)

FOREIGN PATENT DOCUMENTS

AU 276250 7/1965
BR 0711395 A2 11/2011
(Continued)

OTHER PUBLICATIONS

Fibers: Acetate by Joseph W. Schappel, Van Nostrand's Encyclopedia of Chemistry, 5th Edition, Feb. 2005, pp. 624-626, retrieved from https://onlinelibrary.wiley.com/doi/pdf/10.1002/0471740039.vec 1025 (Year: 2005).*
(Continued)

*Primary Examiner* — Philip Y Louie
*Assistant Examiner* — Yana B Krinker
(74) *Attorney, Agent, or Firm* — Womble Bond Dickinson (US) LLP

(57) ABSTRACT

The present disclosure relates to reservoirs for storing products in electronic smoking articles. The reservoir is manufactured from cellulose acetate fiber, thermoplastic fiber, non-thermoplastic fiber, or a combination thereof. The reservoir is substantially tubular in shape and is adapted to accommodate internal components of the smoking article thereby increasing reservoir capacity. The internal components particularly can comprise an atomizer, which may include a braided wick.

20 Claims, 9 Drawing Sheets

(51) Int. Cl.
*A24F 40/70* (2020.01)
*A24F 40/10* (2020.01)
*D04C 1/06* (2006.01)

(58) Field of Classification Search
CPC ..... A24F 15/015; A24F 40/00; A24F 40/05; A24F 40/10; A24F 40/20; A24F 40/30; A24F 40/40; A24F 40/42; A24F 40/44; A24F 40/46; A24F 40/465; A24F 40/48; A24F 40/485; A24F 40/49; A24F 40/50; A24F 40/51; A24F 40/53; A24F 40/57; A24F 40/60; A24F 40/65; A24F 40/70; A24F 40/80; A24F 40/85; A24F 40/90; A24F 40/95; A24F 42/00; A24F 42/10; A24F 42/60; A24F 42/80; A24F 42/90; A24F 47/004
See application file for complete search history.

(56) References Cited

U.S. PATENT DOCUMENTS 2,104,266 A 1/1938 McCormick
2,332,799 A 10/1943 Hunn et al.
2,805,669 A 9/1957 Meriro
3,200,819 A 8/1965 Gilbert
3,316,919 A 5/1967 Green et al.
3,398,754 A 8/1968 Tughan
3,419,015 A 12/1968 Wochnowski
3,424,171 A 1/1969 Rooker
3,476,118 A 11/1969 Luttich
4,054,145 A 10/1977 Berndt et al.
4,131,117 A 12/1978 Kite et al.
4,150,677 A 4/1979 Osborne
4,190,046 A 2/1980 Virag
4,219,032 A 8/1980 Tabatznik et al.
4,259,970 A 4/1981 Green, Jr.
4,284,089 A 8/1981 Ray
4,303,083 A 12/1981 Burruss, Jr.
4,449,541 A 5/1984 Mays et al.
4,506,682 A 3/1985 Muller
4,635,651 A 1/1987 Jacobs
4,674,519 A 6/1987 Keritsis et al.
4,708,151 A 11/1987 Shelar
4,714,082 A 12/1987 Banerjee et al.
4,735,217 A 4/1988 Gerth et al.
4,756,318 A 7/1988 Clearman et al.
4,771,795 A 9/1988 White et al.
4,776,353 A 10/1988 Lilja et al.
4,793,365 A 12/1988 Sensabaugh, Jr. et al.
4,800,903 A 1/1989 Ray et al.
4,819,665 A 4/1989 Roberts et al.
4,821,749 A 4/1989 Toft et al.
4,830,028 A 5/1989 Lawson et al.
4,836,224 A 6/1989 Lawson et al.
4,836,225 A 6/1989 Sudoh
4,848,374 A 7/1989 Chard et al.
4,848,376 A 7/1989 Lilja et al.
4,874,000 A 10/1989 Tamol et al.
4,880,018 A 11/1989 Graves, Jr. et al.
4,887,619 A 12/1989 Burcham, Jr. et al.
4,907,606 A 3/1990 Lilja et al.
4,913,168 A * 4/1990 Potter ..... A24F 47/006 131/194
4,917,119 A 4/1990 Potter et al.
4,917,128 A 4/1990 Clearman et al.
4,922,901 A 5/1990 Brooks et al.
4,924,888 A 5/1990 Perfetti et al.
4,928,714 A 5/1990 Shannon
4,938,236 A 7/1990 Banerjee et al.
4,941,483 A 7/1990 Ridings et al.
4,941,484 A 7/1990 Clapp et al.
4,945,931 A 8/1990 Gori
4,947,874 A 8/1990 Brooks et al.
4,947,875 A 8/1990 Brooks et al.
4,972,854 A 11/1990 Kiernan et al.
4,972,855 A 11/1990 Kuriyama et al.
4,986,286 A 1/1991 Roberts et al.
4,987,906 A 1/1991 Young et al.
5,005,593 A 4/1991 Fagg
5,019,122 A 5/1991 Clearman et al.
5,022,416 A 6/1991 Watson
5,042,510 A 8/1991 Curtiss et al.
5,056,537 A 10/1991 Brown et al.
5,060,669 A 10/1991 White et al.
5,060,671 A 10/1991 Counts et al.
5,065,775 A 11/1991 Fagg
5,072,744 A 12/1991 Luke et al.
5,074,319 A 12/1991 White et al.
5,076,296 A 12/1991 Nystrom et al.
5,093,894 A 3/1992 Deevi et al.
5,095,921 A 3/1992 Losee et al.
5,097,850 A 3/1992 Braunshteyn et al.
5,099,862 A 3/1992 White et al.
5,099,864 A 3/1992 Young et al.
5,103,842 A 4/1992 Strang et al.
5,121,757 A 6/1992 White et al.
5,129,409 A 7/1992 White et al.
5,131,415 A 7/1992 Munoz et al.
5,144,962 A 8/1992 Counts et al.
5,143,097 A 9/1992 Sohn et al.
5,146,934 A 9/1992 Deevi et al.
5,159,940 A 11/1992 Hayward et al.
5,159,942 A 11/1992 Brinkley et al.
5,179,966 A 1/1993 Losee et al.
5,211,684 A 5/1993 Shannon et al.
5,220,930 A 6/1993 Gentry
5,224,498 A 7/1993 Deevi et al.
5,228,460 A 7/1993 Sprinkel, Jr. et al.
5,230,354 A 7/1993 Smith et al.
5,235,992 A 8/1993 Sensabaugh
5,243,999 A 9/1993 Smith
5,246,018 A 9/1993 Deevi et al.
5,249,586 A 10/1993 Morgan et al.
5,261,424 A 11/1993 Sprinkel, Jr.
5,269,327 A 12/1993 Counts et al.
5,285,798 A 2/1994 Banerjee et al.
5,293,883 A 3/1994 Edwards
5,301,694 A 4/1994 Raymond
5,303,720 A 4/1994 Banerjee et al.
5,318,050 A 6/1994 Gonzalez-Parra et al.
5,322,075 A 6/1994 Deevi et al.
5,322,076 A 6/1994 Brinkley et al.
5,339,838 A 8/1994 Young et al.
5,345,951 A 9/1994 Serrano et al.
5,353,813 A 10/1994 Deevi et al.
5,357,984 A 10/1994 Farrier et al.
5,360,023 A 11/1994 Blakley et al.
5,369,723 A 11/1994 Counts et al.
5,372,148 A 12/1994 McCafferty et al.
5,377,698 A 1/1995 Litzinger et al.
5,388,574 A 2/1995 Ingebrethsen et al.
5,388,594 A 2/1995 Counts et al.
5,408,574 A 4/1995 Deevi et al.
5,435,325 A 7/1995 Clapp et al.
5,445,169 A 8/1995 Brinkley et al.
5,468,266 A 11/1995 Bensalem et al.
5,468,936 A 11/1995 Deevi et al.
5,479,948 A 1/1996 Counts et al.
5,498,850 A 3/1996 Das
5,498,855 A 3/1996 Deevi et al.
5,499,636 A 3/1996 Baggett, Jr. et al.
5,501,237 A 3/1996 Young et al.
5,505,214 A 4/1996 Collins et al.
5,515,842 A 5/1996 Ramseyer et al.
5,530,225 A 6/1996 Hajaligol
5,551,450 A 9/1996 Hemsley
5,551,451 A 9/1996 Riggs et al.
5,564,442 A 10/1996 MacDonald et al.
5,573,692 A 11/1996 Das et al.
5,591,368 A 1/1997 Fleischhauer et al.
5,593,792 A 1/1997 Farrier et al.
5,595,577 A 1/1997 Bensalem et al.
5,596,706 A 1/1997 Sikk et al.

(56) References Cited

U.S. PATENT DOCUMENTS 5,611,360 A 3/1997 Tang
5,613,504 A 3/1997 Collins et al.
5,613,505 A 3/1997 Campbell et al.
5,649,552 A 7/1997 Cho et al.
5,649,554 A 7/1997 Sprinkel et al.
5,659,656 A 8/1997 Das
5,665,262 A 9/1997 Hajaligol et al.
5,666,976 A 9/1997 Adams et al.
5,666,977 A 9/1997 Higgins et al.
5,666,978 A 9/1997 Counts et al.
5,692,525 A 12/1997 Counts et al.
5,692,526 A 12/1997 Adams et al.
5,708,258 A 1/1998 Counts et al.
5,711,320 A 1/1998 Martin
5,725,152 A 3/1998 Akyu
5,726,421 A 3/1998 Fleischhauer et al.
5,727,571 A 3/1998 Meiring et al.
5,730,158 A 3/1998 Collins et al.
5,750,964 A 5/1998 Counts et al.
5,799,663 A 9/1998 Gross et al.
5,816,263 A 10/1998 Counts et al.
5,819,756 A 10/1998 Mielordt
5,829,453 A 11/1998 White et al.
5,865,185 A 2/1999 Collins et al.
5,865,186 A 2/1999 Volsey, II
5,878,752 A 3/1999 Adams et al.
5,880,439 A 3/1999 Deevi et al.
5,894,841 A 4/1999 Voges
5,915,387 A 7/1999 Baggett, Jr. et al.
5,934,289 A 8/1999 Watkins et al.
5,954,979 A 9/1999 Counts et al.
5,967,148 A 10/1999 Harris et al.
6,026,820 A 2/2000 Baggett, Jr. et al.
6,033,623 A 3/2000 Deevi et al.
6,040,560 A 3/2000 Fleischhauer et al.
6,053,176 A 4/2000 Adams et al.
6,089,857 A 7/2000 Matsuura et al.
6,095,153 A 8/2000 Kessler et al.
6,116,247 A 9/2000 Banyasz et al.
6,119,700 A 9/2000 Fleischhauer et al.
6,125,853 A 10/2000 Susa et al.
6,125,855 A 10/2000 Nevett et al.
6,125,866 A 10/2000 Nichols et al.
6,155,268 A 12/2000 Takeuchi
6,164,287 A 12/2000 White
6,182,670 B1 2/2001 White
6,196,218 B1 3/2001 Voges
6,196,219 B1 3/2001 Hess et al.
6,216,706 B1 4/2001 Kumar et al.
6,289,898 B1 9/2001 Fournier et al.
6,349,729 B1 2/2002 Pham
6,357,671 B1 3/2002 Cewers
6,418,938 B1 7/2002 Fleischhauer et al.
6,446,426 B1 8/2002 Sweeney et al.
6,532,965 B1 3/2003 Abhulimen et al.
6,598,607 B2 7/2003 Adiga et al.
6,601,776 B1 8/2003 Oljaca et al.
6,615,840 B1 9/2003 Fournier et al.
6,688,313 B2 2/2004 Wrenn et al.
6,701,936 B2 3/2004 Shafer et al.
6,715,494 B1 4/2004 McCoy
6,730,832 B1 5/2004 Dominguez et al.
6,772,756 B2 8/2004 Shayan
6,803,545 B2 10/2004 Blake et al.
6,803,550 B2 10/2004 Sharpe et al.
6,810,883 B2 11/2004 Felter et al.
6,854,461 B2 2/2005 Nichols
6,854,470 B1 2/2005 Pu
6,994,096 B2 2/2006 Rostami et al.
7,011,096 B2 3/2006 Li et al.
7,017,585 B2 3/2006 Li et al.
7,025,066 B2 4/2006 Lawson et al.
7,117,867 B2 10/2006 Cox et al.
7,163,015 B2 1/2007 Moffitt
7,173,322 B2 2/2007 Cox et al.
7,185,659 B2 3/2007 Sharpe et al.
7,234,470 B2 6/2007 Yang
7,290,549 B2 11/2007 Banerjee et al.
7,293,565 B2 11/2007 Griffin et al.
7,392,809 B2 7/2008 Larson et al.
7,513,253 B2 4/2009 Kobayashi et al.
7,647,932 B2 1/2010 Cantrell et al.
7,651,077 B1 * 1/2010 Rosener ..... A61L 9/127 261/104
7,690,385 B2 4/2010 Moffitt
7,692,123 B2 4/2010 Baba et al.
7,726,320 B2 6/2010 Robinson et al.
7,775,459 B2 8/2010 Martens, III et al.
7,810,505 B2 10/2010 Yang
7,832,410 B2 11/2010 Hon
7,845,359 B2 12/2010 Montaser
7,878,209 B2 2/2011 Newbery et al.
7,896,006 B2 3/2011 Hamano et al.
8,066,010 B2 11/2011 Newbery et al.
8,079,371 B2 12/2011 Robinson et al.
8,127,772 B2 3/2012 Montaser
8,156,944 B2 4/2012 Han
8,365,742 B2 2/2013 Hon
8,375,957 B2 2/2013 Hon
8,393,331 B2 3/2013 Hon
2002/0146242 A1 10/2002 Vieira
2003/0131859 A1 7/2003 Li et al.
2003/0226837 A1 12/2003 Blake et al.
2004/0020500 A1 2/2004 Wrenn et al.
2004/0050383 A1 3/2004 Cox et al.
2004/0129280 A1 7/2004 Woodson et al.
2004/0149296 A1 8/2004 Rostami et al.
2004/0200488 A1 10/2004 Felter et al.
2004/0224435 A1 11/2004 Shibata et al.
2004/0226568 A1 11/2004 Takeuchi et al.
2004/0255965 A1 12/2004 Perfetti et al.
2005/0016549 A1 1/2005 Banerjee et al.
2005/0016550 A1 1/2005 Katase
2005/0066986 A1 3/2005 Nestor et al.
2005/0151126 A1 7/2005 Yamakawa et al.
2005/0172976 A1 8/2005 Newman et al.
2005/0274390 A1 12/2005 Banerjee et al.
2006/0016453 A1 1/2006 Kim
2006/0032501 A1 2/2006 Hale et al.
2006/0070633 A1 4/2006 Rostami et al.
2006/0071092 A1 4/2006 Harris, Jr.
2006/0162733 A1 7/2006 McGrath et al.
2006/0185687 A1 8/2006 Hearn et al.
2006/0196518 A1 9/2006 Hon
2007/0074734 A1 4/2007 Braunshteyn et al.
2007/0102013 A1 5/2007 Adams et al.
2007/0215167 A1 9/2007 Crooks et al.
2007/0267034 A1 11/2007 Meyer
2007/0283972 A1 12/2007 Monsees et al.
2008/0092912 A1 4/2008 Robinson et al.
2008/0149118 A1 6/2008 Oglesby et al.
2008/0245377 A1 10/2008 Marshall et al.
2008/0257367 A1 10/2008 Paterno et al.
2008/0268735 A1 * 10/2008 Kuroda ..... D01F 8/02 442/308
2008/0276947 A1 11/2008 Martzel
2008/0302374 A1 12/2008 Wengert et al.
2009/0000633 A1 1/2009 Lipowicz
2009/0065010 A1 3/2009 Shands
2009/0095311 A1 4/2009 Hon
2009/0095312 A1 4/2009 Herbrich et al.
2009/0126745 A1 5/2009 Hon
2009/0188490 A1 7/2009 Hon
2009/0230117 A1 9/2009 Fernando et al.
2009/0260641 A1 10/2009 Monsees et al.
2009/0260642 A1 10/2009 Monsees et al.
2009/0272379 A1 11/2009 Thorens et al.
2009/0283103 A1 11/2009 Nielsen et al.
2009/0293892 A1 12/2009 Williams et al.
2009/0320863 A1 12/2009 Fernando et al.
2009/0324206 A1 12/2009 Young et al.
2010/0006113 A1 1/2010 Urtsev et al.
2010/0024834 A1 2/2010 Oglesby et al.
2010/0043809 A1 2/2010 Magnon

(56) References Cited

U.S. PATENT DOCUMENTS

| | | | | |
|---|---|---|---|---|
| 2010/0059070 | A1 | 3/2010 | Potter et al. | |
| 2010/0059073 | A1 | 3/2010 | Hoffmann et al. | |
| 2010/0065075 | A1 | 3/2010 | Banerjee et al. | |
| 2010/0083959 | A1 | 4/2010 | Siller | |
| 2010/0163063 | A1 | 7/2010 | Fernando et al. | |
| 2010/0200006 | A1 | 8/2010 | Robinson et al. | |
| 2010/0229881 | A1 | 9/2010 | Hearn | |
| 2010/0242974 | A1 | 9/2010 | Pan | |
| 2010/0242976 | A1 | 9/2010 | Katayama et al. | |
| 2010/0258139 | A1 | 10/2010 | Onishi et al. | |
| 2010/0300467 | A1 | 12/2010 | Kuistilla et al. | |
| 2010/0307518 | A1 | 12/2010 | Wang | |
| 2010/0313901 | A1 | 12/2010 | Fernando et al. | |
| 2011/0005535 | A1 | 1/2011 | Xiu | |
| 2011/0011396 | A1 | 1/2011 | Fang | |
| 2011/0036363 | A1 | 2/2011 | Urtsev et al. | |
| 2011/0036365 | A1 | 2/2011 | Chong et al. | |
| 2011/0073121 | A1 | 3/2011 | Levin et al. | |
| 2011/0088707 | A1 | 4/2011 | Hajaligol | |
| 2011/0094523 | A1 | 4/2011 | Thorens et al. | |
| 2011/0120480 | A1 | 5/2011 | Brenneise | |
| 2011/0126847 | A1 | 6/2011 | Zuber et al. | |
| 2011/0126848 | A1 | 6/2011 | Zuber et al. | |
| 2011/0155153 | A1 | 6/2011 | Thorens et al. | |
| 2011/0155718 | A1 | 6/2011 | Greim et al. | |
| 2011/0162663 | A1 | 7/2011 | Bryman | |
| 2011/0168194 | A1 | 7/2011 | Hon | |
| 2011/0180082 | A1 | 7/2011 | Banerjee et al. | |
| 2011/0265806 | A1 | 11/2011 | Alarcon et al. | |
| 2011/0309157 | A1 | 12/2011 | Yang et al. | |
| 2012/0042885 | A1 | 2/2012 | Stone et al. | |
| 2012/0048266 | A1 | 3/2012 | Alelov | |
| 2012/0060853 | A1 | 3/2012 | Robinson et al. | |
| 2012/0145169 | A1 | 4/2012 | Wu | |
| 2012/0111347 | A1 | 5/2012 | Hon | |
| 2012/0132643 | A1 | 5/2012 | Choi et al. | |
| 2012/0199146 | A1 | 8/2012 | Marangos | |
| 2012/0231464 | A1 | 9/2012 | Yu et al. | |
| 2012/0279512 | A1 | 11/2012 | Hon | |
| 2012/0298123 | A1 | 11/2012 | Woodcock et al. | |
| 2012/0031882 | A1 | 12/2012 | Abehasera | |
| 2013/0081642 | A1 | 4/2013 | Safari | |
| 2013/0192620 | A1* | 8/2013 | Tucker ..... | H05B 3/0014 131/329 |
| 2013/0306064 | A1 | 11/2013 | Thorens et al. | |
| 2013/0306084 | A1 | 11/2013 | Flick | |
| 2013/0319435 | A1 | 12/2013 | Flick | |
| 2013/0340775 | A1 | 12/2013 | Juster et al. | |
| 2014/0238424 | A1 | 8/2014 | Macko | |

FOREIGN PATENT DOCUMENTS

| | | | |
|---|---|---|---|
| CA | 2 641 869 | | 5/2010 |
| CA | 2 752 255 | | 8/2010 |
| CN | 1043843 | C | 6/1999 |
| CN | 1541577 | | 11/2004 |
| CN | 2719043 | | 8/2005 |
| CN | 200997909 | | 1/2008 |
| CN | 101116542 | | 2/2008 |
| CN | 101176805 | | 5/2008 |
| CN | 101198734 | A | 6/2008 |
| CN | 101205369 | A | 6/2008 |
| CN | 201379072 | | 1/2010 |
| CN | 201393548 | Y | 2/2010 |
| CN | 201821914 | U | 5/2011 |
| CN | 201900065 | U | 7/2011 |
| CN | 202014573 | | 10/2011 |
| CN | 202354377 | | 8/2012 |
| CN | 202658322 | | 1/2013 |
| DE | 10 2006 004 484 | | 8/2007 |
| DE | 102006041042 | | 3/2008 |
| DE | 20 2009 010 400 | | 11/2009 |
| EP | 0 295 122 | | 12/1988 |
| EP | 0 358 114 | | 3/1990 |
| EP | 0 430 566 | | 6/1991 |
| EP | 0 845 220 | | 6/1998 |
| EP | 893071 | B1 | 3/2002 |
| EP | 1 618 803 | | 1/2006 |
| EP | 2 316 286 | | 5/2011 |
| EP | 2 468 118 | | 6/2012 |
| GB | 1444461 | | 7/1976 |
| GB | 2469850 | | 11/2010 |
| JP | H04179426 | | 6/1992 |
| JP | H07253202 | | 10/1995 |
| JP | H11318418 | | 11/1999 |
| WO | WO 1986/02528 | | 5/1986 |
| WO | WO 1997/48293 | | 12/1997 |
| WO | WO 02/37990 | | 5/2002 |
| WO | WO 03/034847 | | 5/2003 |
| WO | WO 2004/043175 | | 5/2004 |
| WO | WO 2007/131449 | | 11/2007 |
| WO | WO 2009/105919 | | 9/2009 |
| WO | WO 2009/155734 | | 12/2009 |
| WO | WO 2010/003480 | | 1/2010 |
| WO | WO 2010/045670 | | 4/2010 |
| WO | WO 2010/073122 | | 7/2010 |
| WO | WO 2010/091593 | | 8/2010 |
| WO | WO 2010/118644 | | 10/2010 |
| WO | WO 2010/140937 | | 12/2010 |
| WO | WO 2011/010334 | | 1/2011 |
| WO | WO 2011/081558 | | 7/2011 |
| WO | WO 2012/072762 | | 6/2012 |
| WO | WO 2012085205 | | 6/2012 |
| WO | WO 2012/100523 | | 8/2012 |
| WO | WO 2013/089551 | | 6/2013 |

OTHER PUBLICATIONS

Bo et al., "Wisdom Flashes, Invention and Discovery," Xiyuan Press, pp. 11-12; ISBN 978-7-80210-009-1, 2009, Edition 2.

Decision of Rejection issued Mar. 4, 2025, in corresponding Japanese patent application No. 2023-092893.

* cited by examiner

ELECTRONIC SMOKING ARTICLE WITH IMPROVED STORAGE AND TRANSPORT OF AEROSOL PRECURSOR COMPOSITIONS

CROSS-REFERENCE TO RELATED APPLICATIONS

The present application is a continuation of U.S. application Ser. No. 13/802,950, filed Mar. 14, 2013, the disclosure of which is incorporated by reference herein in its entirety.

FIELD OF THE DISCLOSURE

The present disclosure relates to aerosol delivery articles and uses thereof, and in particular to articles that can be considered to be smoking articles for purposes of yielding components of tobacco and other materials in an inhalable form. Highly preferred components of such articles are made or derived from tobacco, or those articles can be characterized as otherwise incorporating tobacco for human consumption.

BACKGROUND

Many smoking devices have been proposed through the years as improvements upon, or alternatives to, smoking products that require combusting tobacco for use. Many of those devices purportedly have been designed to provide the sensations associated with cigarette, cigar, or pipe smoking, but without delivering considerable quantities of incomplete combustion and pyrolysis products that result from the burning of tobacco. To this end, there have been proposed numerous smoking products, flavor generators, and medicinal inhalers that utilize electrical energy to vaporize or heat a volatile material, or attempt to provide the sensations of cigarette, cigar, or pipe smoking without burning tobacco to a significant degree. See, for example, the various alternative smoking articles, aerosol delivery devices and heat generating sources set forth in the background art described in U.S. Pat. No. 7,726,320 to Robinson et al., U.S. patent application Ser. No. 13/432,406, filed Mar. 28, 2012, U.S. patent application Ser. No. 13/536,438, filed Jun. 28, 2012, U.S. patent application Ser. No. 13/602,871, filed Sep. 4, 2012, and U.S. patent application Ser. No. 13/647,000, filed Oct. 8, 2012, which are incorporated herein by reference.

Certain tobacco products that have employed electrical energy to produce heat for smoke or aerosol formation, and in particular, certain products that have been referred to as electronic cigarette products, have been commercially available throughout the world. Representative products that resemble many of the attributes of traditional types of cigarettes, cigars or pipes have been marketed as ACCORD® by Philip Morris Incorporated; ALPHA™, JOVE 510™ and M4™ by InnoVapor LLC; CIRRUS™ and FLING™ by White Cloud Cigarettes; COHITA™, COLIBRI™, ELITE CLASSIC™, MAGNUM™, PHANTOM™ and SENSE™ by Epuffer® International Inc.; DUOPRO™, STORM™ and VAPORKING® by Electronic Cigarettes, Inc.; EGAR™ by Egar Australia; eGo-C™ and eGo-T™ by Joyetech; ELUSION™ by Elusion UK Ltd; EONSMOKE® by Eonsmoke LLC; GREEN SMOKE® by Green Smoke Inc. USA; GREENARETTE™ by Greenarette LLC; HALLIGAN™, HENDU™, JET™, MAXXQ™, PINK™ and PITBULL™ by Smoke Stik®; HEATBAR™ by Philip Morris International, Inc.; HYDRO IMPERIAL™ and LXE™ from Crown7; LOGIC™ and THE CUBAN™ by LOGIC Technology; LUCI® by Luciano Smokes Inc.; METRO® by Nicotek, LLC; NJOY® and ONEJOY™ by Sottera, Inc.; NO. 7™ by SS Choice LLC; PREMIUM ELECTRONIC CIGARETTE™ by PremiumEstore LLC; RAPP E-MYSTICK™ by Ruyan America, Inc.; RED DRAGON™ by Red Dragon Products, LLC; RUYAN® by Ruyan Group (Holdings) Ltd.; SMART SMOKER® by The Smart Smoking Electronic Cigarette Company Ltd.; SMOKE ASSIST® by Coastline Products LLC; SMOKING EVERYWHERE® by Smoking Everywhere, Inc.; V2CIGS™ by VMR Products LLC; VAPOR NINE™ by VaporNine LLC; VAPOR4LIFE® by Vapor 4 Life, Inc.; VEPPO™ by E-CigaretteDirect, LLC and VUSE® by R. J. Reynolds Vapor Company. Yet other electrically powered aerosol delivery devices, and in particular those devices that have been characterized as so-called electronic cigarettes, have been marketed under the tradenames BLU™; COOLER VISIONS™; DIRECT E-CIG™; DRAGONFLY™; EMIST™; EVERSMOKE™; GAMUCCI®; HYBRID FLAME™; KNIGHT STICKS™; ROYAL BLUES™; SMOKETIP® and SOUTH BEACH SMOKE™.

It would be desirable to provide a smoking article that employs heat produced by electrical energy to provide the sensations of cigarette, cigar, or pipe smoking, that does so without combusting tobacco to any significant degree, that does so without the need of a combustion heat source, and that does so without necessarily delivering considerable quantities of incomplete combustion and pyrolysis products.

BRIEF SUMMARY

The present disclosure provides a smoking article and related components and methods. According to one aspect, disclosed herein is an electronic smoking article that includes an electrical power source and a reservoir that includes cellulose acetate and is configured to hold a product. The product can include an aerosol precursor composition. The reservoir can be substantially shaped as a cylinder having a hollow interior portion. The reservoir includes an exterior surface substantially adapted to conform to an interior surface of the smoking article. The reservoir can be shaped and dimensioned to accommodate one or more further components of the smoking article. The one or more further components can be an atomizer. The atomizer can include a heater such as, for example, a resistive heating element. The atomizer can further include a liquid transport element. For example, the liquid transport element can be a continuous, elongated article. The article can be adapted for wicking a liquid. The heater can be in a heating arrangement with at least a portion of the liquid transport element. For example, the heater can be in contact with the liquid transport element and can be positioned at about a midpoint of the liquid transport element. The liquid transport element can be a braided wick. The braided wick can be a sheath/core wick, and the sheath can be braided. The core of the sheath/core wick can be a twisted yarn. The atomizer can include electrically conducting terminals extending along at least a portion of the liquid transport element and in an electrically conducting arrangement with the heater. The hollow interior of the reservoir can include a central cavity defined by an inner wall of the reservoir. Such inner wall can include one or more indentations or protrusions formed therein. For example, the inner wall can include diametrically opposed grooves extending into the reservoir. Such grooves (or similar arrangement) can be adapted to mate with at least a portion of the atomizer. The liquid transport element can be operatively positioned within the smoking article to be substantially in contact with the product. The reservoir can be formed from a cellulose acetate fiber tow. In some embodiments, the cellulose acetate fibers can have a size of about 0.5 dpf or greater, particularly about 0.5 to about 20 dpf. The hollow cellulose acetate reservoir in the shape of a tube or a cylinder can have a wall thickness of about 1 mm to about 4 mm. The reservoir can comprise about 70% to about 99% by weight cellulose acetate and about 2% to about 25% by weight of a binder. In further embodiments, the reservoir can consist of 100% cellulose acetate. If desired, further fibers and materials can be comprised with the cellulose acetate. In certain embodiments, the reservoir can be a woven or non-woven fibrous mat that is in the form of a tube or a hollow cylinder.

The present disclosure also provides wicks that can be particularly useful in an electronic smoking article. In certain embodiments, a wick suitable for use in an electronic smoking article can comprise a braid of at least 4 separate fibers or yarns. In particular, at least one of the fibers or yarns forming the braid can be C-glass or E-glass. In further embodiments the wick can comprise a braid of at least 8 separate fibers or yarns. Moreover, the braided wick can be a sheath/core wick. Specifically, the braided wick can be a sheath that surrounds a core. The core can be non-braided, can be formed of a different material than the braided sheath, or can be both non-braided and formed of a different material than the braided sheath. In some embodiments, the core can comprise a twisted yarn.

In further embodiments, the present disclosure can provide an electronic smoking article comprising a reservoir with an aerosol precursor composition (e.g., a liquid composition) stored therein and a braided wick in fluid communication with the reservoir. The braided wick can be as discussed above. The reservoir particularly may be substantially shaped as a cylinder or be tube shaped and have a hollow interior portion. The reservoir particularly can comprise cellulose acetate. The reservoir may be a molded element. The reservoir also may be a woven or non-woven fibrous mat, such as comprising fibers of cellulose acetate. The fibrous mat can be rolled or otherwise formed to the tube or hollow cylinder shape.

In other embodiments, the present disclosure can provide a cartridge for an electronic smoking article. The cartridge can comprise an atomizer at least partially positioned within a hollow interior of a tube-shaped reservoir adapted for holding an aerosol precursor composition, the reservoir tube being positioned within a hollow shell. In particular, the reservoir tube can be formed of cellulose acetate. The atomizer specifically can comprise a continuous, elongated wick having two opposing ends, a heater in connection with the wick and positioned at about a midpoint thereof, and electrically conducting terminals positioned in physical contact with the wick and in electrical connection with the heater. The hollow shell can comprise a first end adapted to engage a control component (e.g., a controller or power unit of an electronic smoking article) and an opposing mouthend. The heater of the atomizer can extend out of the reservoir tube in a cavity formed at the mouthend of the hollow shell. The wick can be a braided wick as discussed herein.

In another aspect, a method of making an electronic smoking article is provided. The method includes the step of providing a cylinder comprising cellulose acetate having a hollow interior portion. At least part of the hollow interior can be shaped and dimensioned to accommodate one or more further components of the smoking article. The method further includes the step of inserting an atomizer into the hollow interior of the cellulose acetate cylinder. The method can further include the steps of inserting the cylinder and atomizer into a hollow shell and connecting the atomizer to a power source. The power source can be a battery. The hollow shell can be a cartridge portion of the electronic smoking article.

BRIEF DESCRIPTION OF THE FIGURES

Figure 1:
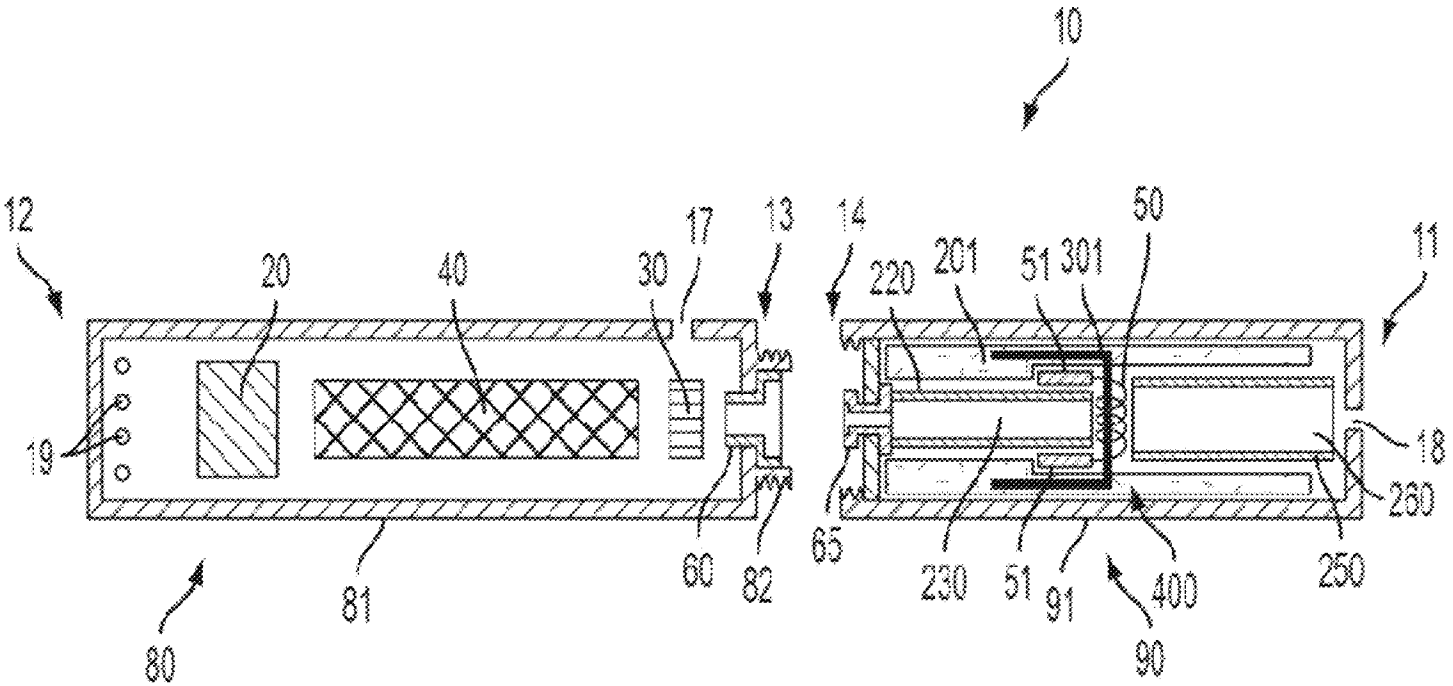
Figure 2:
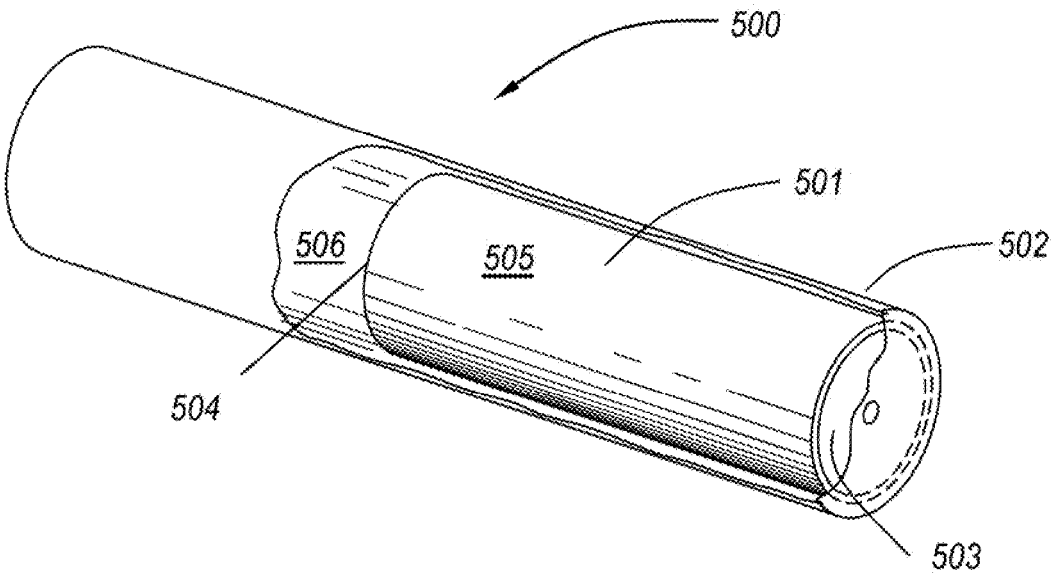
Figure 3:
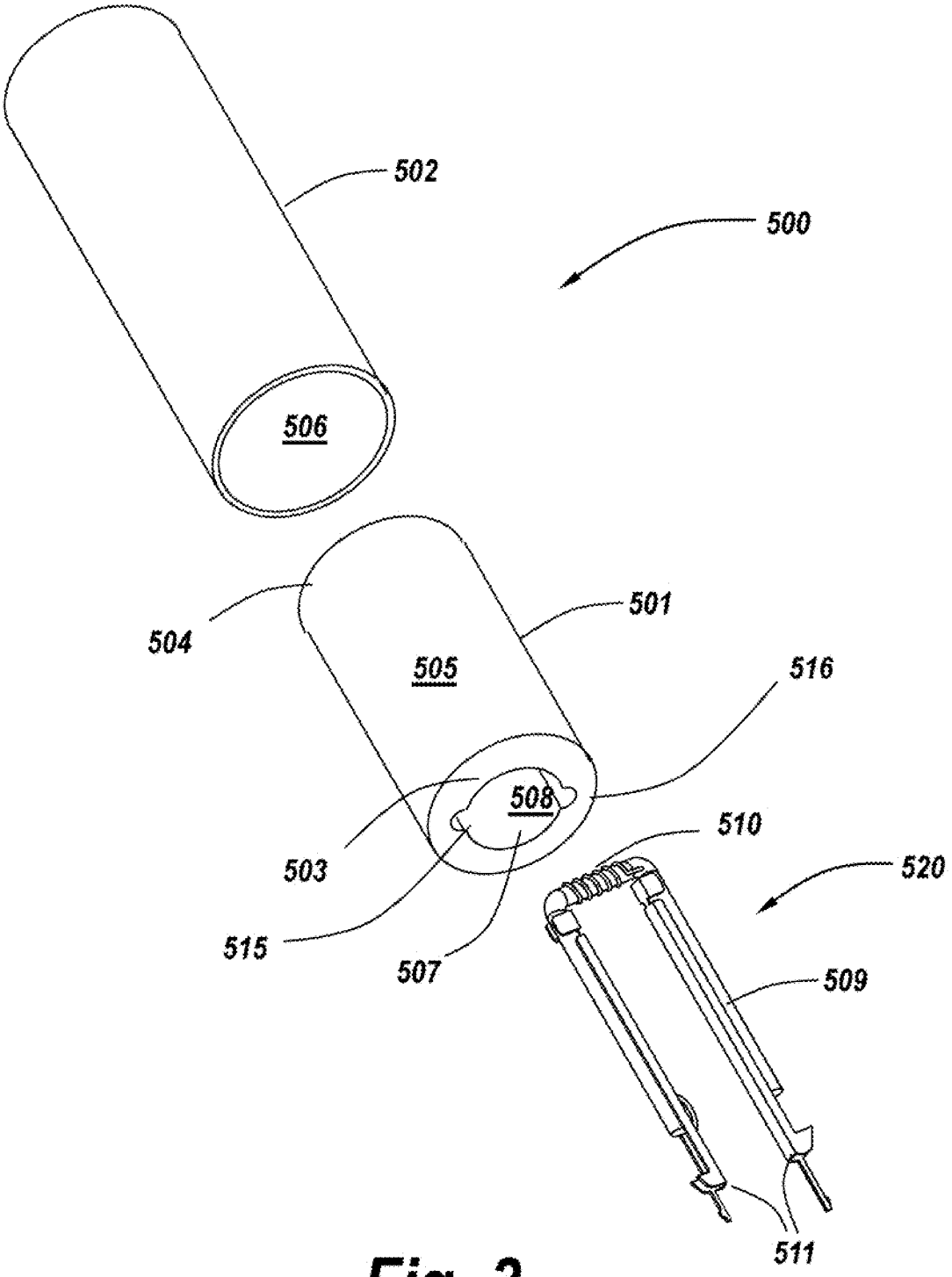
Figure 4:
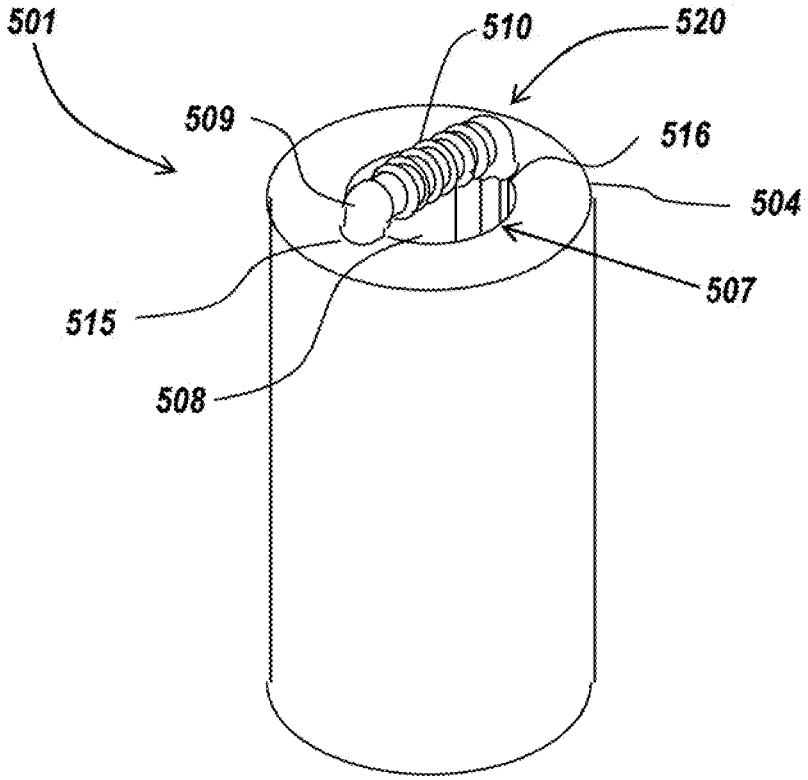
Figure 5:
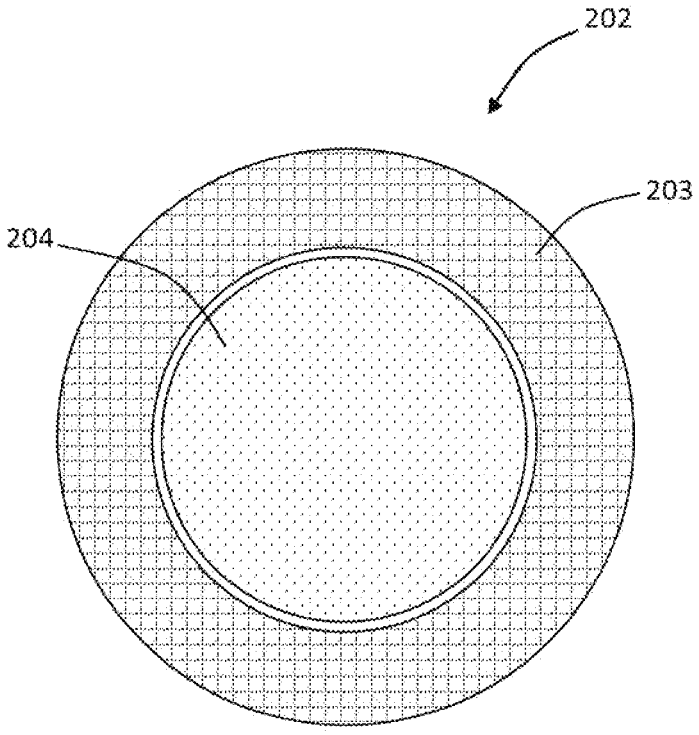
Figure 6:
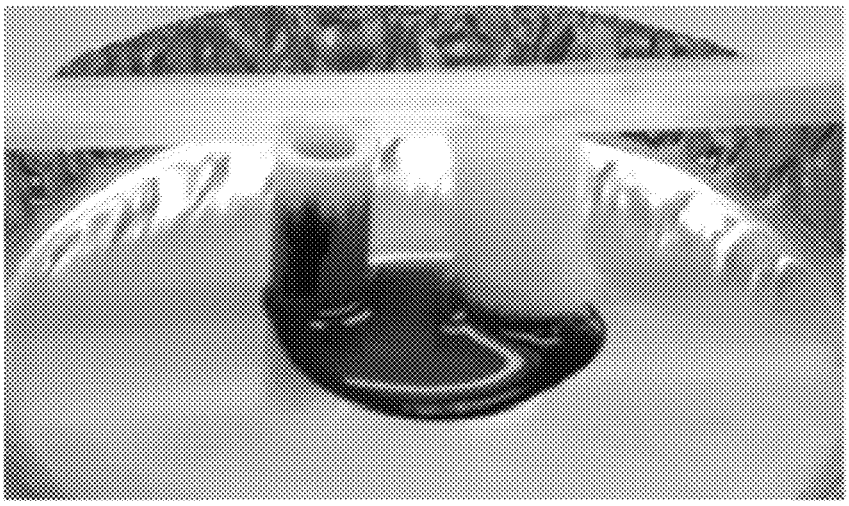
Figure 7:
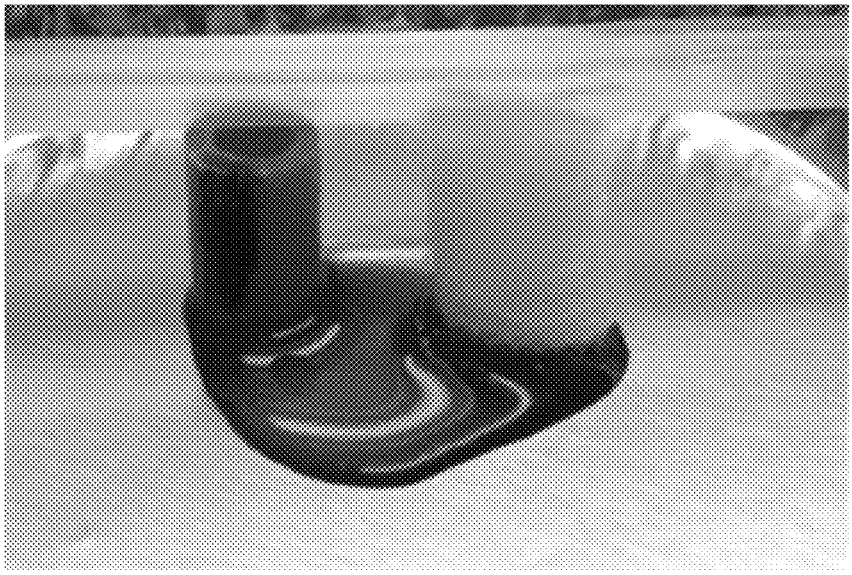
Figure 8:
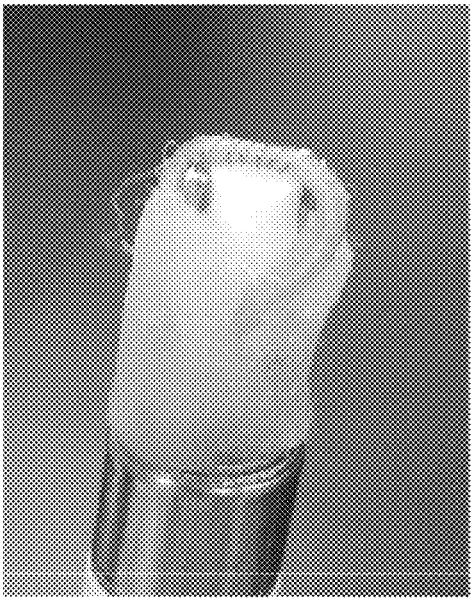
Figure 9:
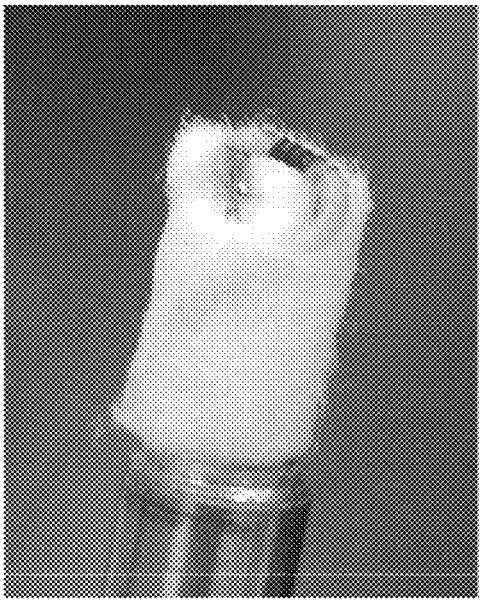
Figure 10:
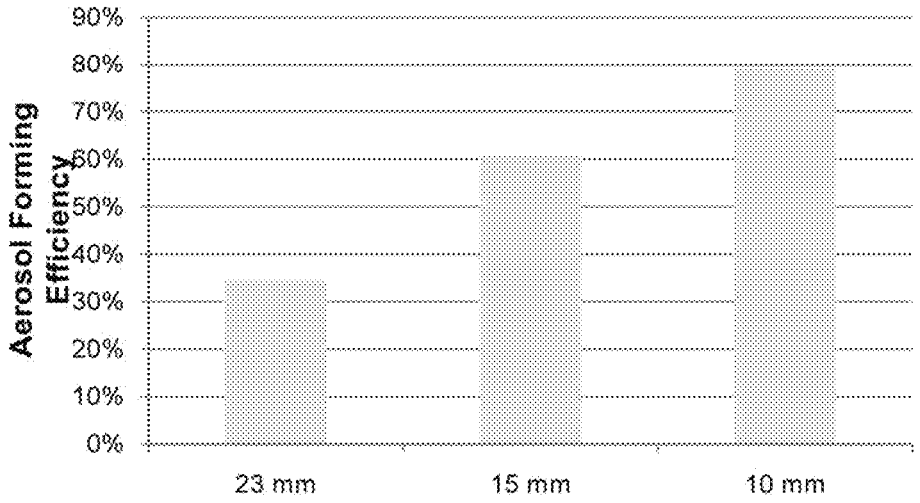
Figure 11:
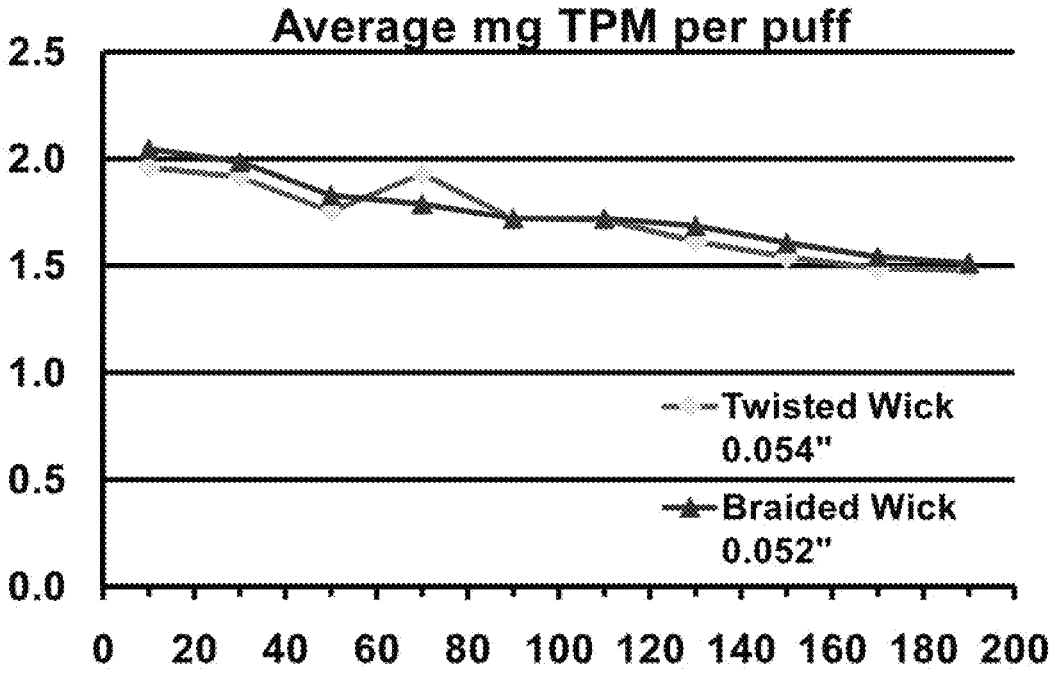
Figure 12:
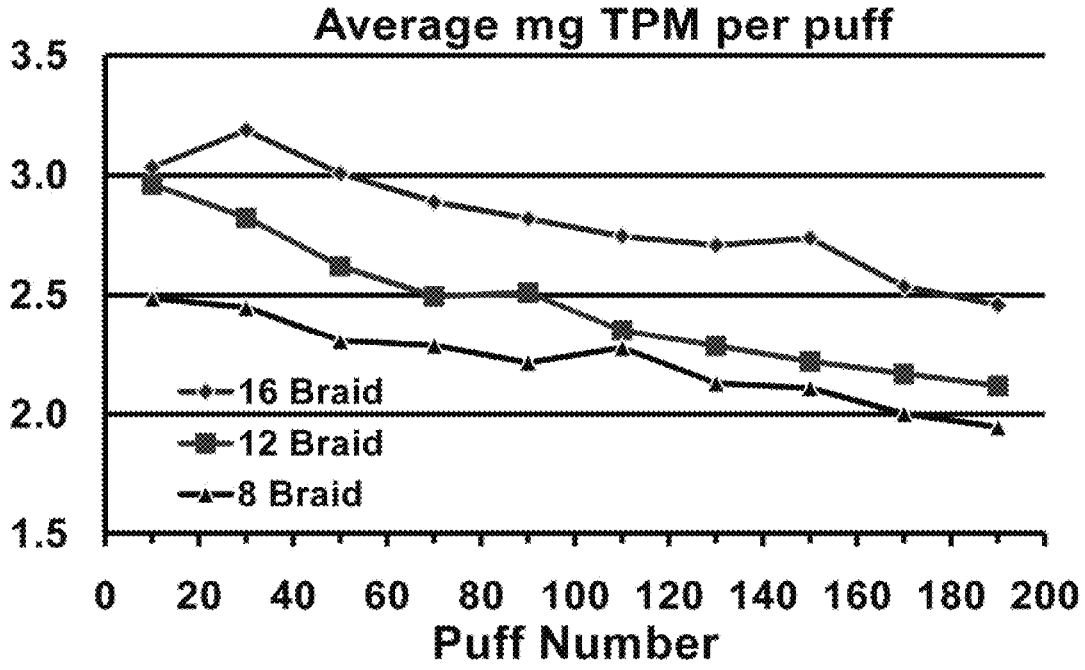

Having thus described the disclosure in the foregoing general terms, reference will now be made to the accompanying drawings, which are not necessarily drawn to scale, and wherein:

FIG. 1 illustrates a sectional view through an embodiment of a smoking article;

FIG. 2 illustrates a partial cut-away view of an electronic smoking article containing a reservoir according to an embodiment of the present disclosure;

FIG. 3 illustrates an exploded view of an electronic smoking article containing a reservoir and an atomizer according to an embodiment of the present disclosure;

FIG. 4 provides a perspective view of a combined reservoir and atomizer according one embodiment of the disclosure;

FIG. 5 is a cross-section of a sheath/core wick according to an exemplary embodiment of the present disclosure;

FIG. 6 and FIG. 7 are images of a reservoir according to an embodiment of the present disclosure and a comparative reservoir after being placed in a liquid composition to evaluate the ability of the reservoir to become saturated by the liquid;

FIG. 8 is an image of a reservoir according to an embodiment of the present disclosure being saturated with an aerosol precursor composition;

FIG. 9 is an image of the reservoir from FIG. 8 after depletion of the aerosol precursor composition through use of the reservoir in an aerosolization smoking article;

FIG. 10 is a graph illustrating aerosol forming efficiency of reservoirs according to embodiments of the present disclosure;

FIG. 11 is a graph illustrating the change in average mg of total particulate matter (TPM) delivered in a puff of an aerosolization smoking article utilizing a twisted wick or a braided wick according to an embodiment of the preset disclosure; and FIG. 12 is a graph illustrating the change in average mg of total particulate matter (TPM) delivered in a puff of an aerosolization smoking article including braided wicks according to embodiments of the preset disclosure formed from 8, 12, or 16 separate fiberglass yarns.

DETAILED DESCRIPTION

The present disclosure will now be described more fully hereinafter with reference to exemplary embodiments thereof. These exemplary embodiments are described so that this disclosure will be thorough and complete, and will fully convey the scope of the disclosure to those skilled in the art. Indeed, the present disclosure may be embodied in many different forms and should not be construed as limited to the embodiments set forth herein; rather, these embodiments are provided so that this disclosure will satisfy applicable legal requirements. As used in the specification, and in the appended claims, the singular forms “a”, “an”, “the”, include plural referents unless the context clearly dictates otherwise.

The present disclosure relates to articles that use electrical energy to heat a material (preferably without combusting the material to any significant degree) to form an inhalable substance, the articles being sufficiently compact to be considered "hand-held" devices. Particularly, the present disclosure relates to reservoirs for storing aerosol precursor compositions in electronic smoking articles. The reservoir can be fibrous and can be made from a variety of fibers. For example, the reservoir can be manufactured from cellulose acetate fiber. The reservoir can be substantially tubular in shape and can be adapted to accommodate further internal components of the smoking article.

The present disclosure relates to articles (and the manufacture thereof) that use electrical energy to heat a material (preferably without combusting the material to any significant degree) to form an inhalable substance, the articles being sufficiently compact to be considered "hand-held" devices. In certain embodiments, the articles can particularly be characterized as smoking articles. As used herein, the term "smoking article" is intended to mean an article that provides many of the sensations (e.g., inhalation and exhalation rituals, types of tastes or flavors, organoleptic effects, physical feel, use rituals, visual cues such as those provided by visible aerosol, and the like) of smoking a cigarette, cigar, or pipe without any substantial degree of combustion of any component of the article. As used herein, the term "smoking article" does not necessarily mean that, in operation, the article produces smoke in the sense of the aerosol resulting from by-product of combustion or pyrolysis of tobacco, but rather, that the article yields vapors (including vapors within aerosols that can be considered to be visible aerosols that might be considered to be described as smoke-like) resulting from volatilization or vaporization of certain components of the article or device. In highly preferred embodiments, articles characterized as smoking articles incorporate tobacco and/or components derived from tobacco.

In further embodiments, the articles that can be manufactured according to the present disclosure can be characterized as being vapor-producing articles, aerosolization articles, or medicament delivery articles. Thus, the articles can be arranged so as to provide one or more substances (e.g., flavors and/or pharmaceutical active ingredients) in an inhalable form or state. For example, inhalable substances can be substantially in the form of a vapor (i.e., a substance that is in the gas phase at a temperature lower than its critical point). Alternatively, inhalable substances can be in the form of an aerosol (i.e., a suspension of fine solid particles or liquid droplets in a gas). For purposes of simplicity, the term "aerosol" as used herein is meant to include vapors, gases and aerosols of a form or type suitable for human inhalation, whether or not visible, and whether or not of a form that might be considered to be smoke-like.

In use, smoking articles that can be manufactured according to the present disclosure may be subjected to many of the physical actions of an individual in using a traditional type of smoking article (e.g., a cigarette, cigar or pipe that is employed by lighting with a flame and used by inhaling tobacco that is subsequently burned). For example, the user of a smoking article of the present invention can hold that article much like a traditional type of smoking article, draw on one end of that article for inhalation of aerosol produced by that article, and take puffs at selected intervals of time.

A smoking article that can be manufactured according to one aspect of the present disclosure can include a number of components provided within an outer shell or body. The overall design of the outer shell or body can vary, and the format or configuration of the outer body that can define the overall size and shape of the smoking article can vary. Typically, an elongated body resembling shape of a cigarette or cigar can be a formed from a single, unitary shell; or the elongated body can be formed of two or more separable pieces. For example, a smoking article can comprise an elongated shell or body that can be substantially tubular in shape, and as such, resemble the shape of a conventional cigarette or cigar. In one embodiment, all of the components of the smoking article are contained within one outer body or shell. Alternatively, a smoking article can comprise two shells that are joined and are separable. For example, a smoking article can possess at one end a control body comprising a shell containing one or more reusable components (e.g., a rechargeable battery and various electronics for controlling the operation of that article), and at the other end and removably attached thereto a shell containing a disposable portion (e.g., a disposable flavor-containing cartridge). Additionally, various smoking article designs and component arrangements can be appreciated upon consideration of the commercially available electronic smoking articles, such as those representative products listed in the background art section of the present disclosure.

A smoking article that can be manufactured according to one aspect of the present disclosure can include some combination of power source (i.e., an electrical power source), at least one control component (e.g., means for actuating, controlling, regulating and ceasing power for heat generation, such as by controlling electrical current flow the power source to other components of the article), a heater or heat generation component (e.g., an electrical resistance heating element or component commonly referred to as an "atomizer"), and an aerosol precursor component (e.g., commonly a liquid capable of yielding an aerosol upon application of sufficient heat, such as ingredients commonly referred to as "smoke juice," "e-liquid" and "e-juice"), and a mouthend region or tip for allowing draw upon the smoking article for aerosol inhalation (e.g., a defined air flow path through the article such that aerosol generated can be withdrawn therefrom upon draw). Alignment of the components within the article can vary. In specific embodiments, the aerosol precursor component can be located near an end of the article (e.g., with a cartridge, which in certain circumstances can be replaceable and disposable) that is proximal to the mouth of a user so as to maximize aerosol delivery to the user. Other configurations, however, are not excluded. Generally, the heater component can be positioned sufficiently near that aerosol precursor component so that heat from the heater component can volatilize the aerosol precursor (as well as one or more flavorants, medicaments, or the like that may likewise be provided for delivery to a user) and form an aerosol for delivery to the user. When the heating member heats the aerosol precursor component, an aerosol is formed, released, or generated in a physical form suitable for inhalation by a consumer. It should be noted that the foregoing terms are meant to be interchangeable such that reference to release, releasing, releases, or released includes form or generate, forming or generating, forms or generates, and formed or generated. Specifically, an inhalable substance is released in the form of a vapor or aerosol or mixture thereof. Additionally, the selection of various smoking article components can be appreciated upon consideration of the commercially available electronic smoking articles, such as those representative products listed in the background art section of the present disclosure.

A smoking article that can be manufactured according to one aspect of the present disclosure can include a battery or other electrical power source to provide current flow sufficient to provide various functionalities to the article, such as resistive heating, powering of control systems, powering of indicators, and the like. The power source can take on various embodiments. Preferably, the power source is able to deliver sufficient power to rapidly heat the heating member to provide for aerosol formation and power the article through use for the desired duration of time. The power source preferably is sized to fit conveniently within the article so that the article can be easily handled; and additionally, preferred a preferred power source is of a sufficiently light weight to not detract from a desirable smoking experience.

An exemplary smoking article 10 according to the disclosure is shown in FIG. 1. As seen in the surface illustrated therein, the smoking article 10 can comprise a control body 80 and a cartridge 90 that can be aligned in a functioning relationship. In this regard, the control body 80 and the cartridge 90 may be attachable and detachable from each other. Although a threaded engagement is illustrated in FIG. 1, it is understood that further means of engagement are encompassed, such as a press-fit engagement, a magnetic engagement, or the like. The cartridge can particularly include a single use connector as otherwise described herein.

In specific embodiments, the control body 80 may be referred to as being reusable, and the cartridge 90 may be referred to as being disposable. In some embodiments, the entire smoking article may be characterized as being disposable in that the control body may be configured for only a limited number of uses (e.g., until a battery power component no longer provides sufficient power to the smoking article) with a limited number of cartridges and, thereafter, the entire smoking article 10, including the control body, may be discarded. In other embodiments, the control body may have a replaceable battery such that the control body can be reused through a number of battery exchanges and with many cartridges. Similarly, the smoking article 10 may be rechargeable and thus may be combined with any type of recharging technology, including connection to a typical electrical outlet, connection to a car charger (i.e., cigarette lighter receptacle), and connection to a computer, such as through a USB cable.

The control body 80 includes a control component 20, a flow sensor 30, and a battery 40. Although these components are illustrated in a specific alignment, it is understood that various alignments of the components are encompassed by the present disclosure. The control body 80 further includes a plurality of indicators 19 at a distal end 12 of the control body shell 81. Such indicators 19 can show the number of puffs taken or remaining from the smoking article, can be indicative of an active or inactive status, can light up in response to a puff, or the like. The indicators can be provided in varying numbers and can take on different shapes and can even be simply an opening in the body (such as for release of sound when such indicators are present).

Various positions for one or more air intakes 17 are encompassed by the present disclosure. As shown, the air intake 17 may be positioned in the control body shell 81 such that air drawn through the intake sufficiently contacts the flow sensor 30 to activate the sensor (although other positions are encompassed, particularly if different sensing means are provided or if manual actuation, such as with a push button, is provided). A receptacle 60 also is included at the proximal attachment end 13 of the control body 80 and extends into the control body projection 82 to allow for ease of electrical connection with the resistive heating element 50 when the cartridge 90 is attached to the control body. In the illustrated embodiment, the receptacle 60 includes a central open passage to facilitate air flow from the air intake in the control body into the cartridge during use of the article 10.

The cartridge 90 includes a cartridge shell 91 with a mouth opening 18 at the mouthend 11 thereof to allow passage of air and entrained vapor (i.e., the components of the aerosol precursor composition in an inhalable form) from the cartridge to a consumer during draw on the smoking article 10. The smoking article 10 according to the present disclosure may have an overall shape that may be defined as being substantially rod-like or substantially tubular shaped or substantially cylindrically shaped. As illustrated in FIG. 1, the smoking article 10 has a substantially round cross-section; however, other cross-sectional shapes (e.g., oval, square, triangle, etc.) also are encompassed by the present disclosure. Such language that is descriptive of the physical shape of the smoking article may also be applied to the individual units of the smoking article in embodiments comprising multiple units, such as a control body and a cartridge.

In preferred embodiments, the smoking article 10 may take on a size that is comparative to a cigarette or cigar shape. Thus, the smoking article may have a diameter of about 5 mm to about 25 mm, about 5 mm to about 20 mm, about 6 mm to about 15 mm, or about 6 mm to about 10 mm. Such dimension may particularly correspond to the outer diameter of the control body shell 81 and/or the cartridge shell 91. The control body can have a length of about 50 mm to about 110 mm, about 60 mm to about 100 mm, or about 65 mm to about 95 mm. The cartridge can have a length of about 20 mm to about 60 mm, about 25 mm to about 55 mm, or about 30 mm to about 50 mm. The overall length of the combined cartridge and control body (or the overall length of a smoking article according to the disclosure formed of a single, unitary shell) can be approximately equal to or less than the length of a typical cigarette—e.g., about 70 mm to about 130 mm, about 80 mm to about 125 mm, or about 90 mm to about 120 mm.

The cartridge shell 91 of the smoking article 10 can be formed of any material suitable for forming and maintaining an appropriate conformation, such as a tubular shape, and for retaining therein the suitable components of the smoking article. The body can be formed of a single wall, as shown in FIG. 1. The cartridge shell 91 can be formed of a material (natural or synthetic) that is heat resistant so as to retain its structural integrity—e.g., does not degrade—at least at a temperature that is the heating temperature provided by the resistive heating element. In some embodiments, a heat resistant polymer may be used. In other embodiments, the body can be formed from paper, or from metal, such as stainless steel. As further discussed herein, the body, such as a paper tube, may have one or more layers associated therewith that function to substantially prevent movement of vapor therethrough. In one example, an aluminum foil layer may be laminated to one surface of the body. Ceramic materials also may be used.

The cartridge 90 further includes a resistive heating element 50 in the form of a metal wire coil. The resistive heating element includes terminals 51 (e.g., positive and negative terminals) at the opposing ends thereof for facilitating current flow through the resistive heating element and for attachment of the appropriate wiring (not illustrated) to form an electrical connection of the resistive heating element with the battery 40 when the cartridge 90 is connected to the control body 80. Specifically, a plug 65 is positioned at the distal attachment end 14 of the cartridge. When the cartridge 90 is connected to the control body 80, the plug 65 engages the receptacle 60 to form an electrical connection such that current controllably flows from the battery 40, through the receptacle and plug, and to the resistive heating element 50. The cartridge shell 91 can continue across the distal attachment end such that this end of the cartridge is substantially closed with the plug protruding therefrom. As illustrated in FIG. 1, the plug 65 includes an open central passage that aligns with the open central passage in the receptacle 60 to allow air to flow from the control body 80 and into the cartridge 90.

Generally, in use, when a consumer draws on the mouthend 11 of the cartridge, the flow sensor 30 detects the change in flow and activates the control component 20 to facilitate current flow through the resistive heating element 50. Thus, it is useful for air flow to travel through the control body 80 in a manner that flow sensor 30 detects air flow almost instantaneously.

The control algorithm may call for power to the resistive heating element 50 to cycle and thus maintain a defined temperature. The control algorithm therefore can be programmed to automatically deactivate the smoking article 10 and discontinue power flow through the smoking article after a defined time lapse without a puff by a consumer. Moreover, the smoking article can include a temperature sensor to provide feedback to the control component. Such sensor can be, for example, in direct contact with the resistive heating element 50. Alternative temperature sensing means likewise may be used, such as relying upon logic control components to evaluate resistance through the resistive heating element and correlate such resistance to the temperature of the element. In other embodiments, the flow sensor 30 may be replaced by appropriate components to provide alternative sensing means, such as capacitive sensing. Still further, one or more control buttons can be included to allow for manual actuation by a consumer to elicit a variety of functions, such as powering the article 10 on and off, turning on the heating element 50 to generate a vapor or aerosol for inhalation, or the like.

When the flow sensor 30 is positioned within the control body 80, it can be useful to have an air intake 17 on the control body. If desired, a sealed flow path can be provided such that the flow sensor 30 within the control body 80 is in fluid connection with the cartridge interior after the cartridge and the control body are engaged, such fluid connection being sealed with respect to the remainder of the components within the control body but opening into the cartridge 90 when attached to the control body. Further, in other embodiments, the flow sensor 30 can be located within the cartridge 90 instead of the control body 80.

A reservoir may utilize a transport element to transport an aerosol precursor composition to an aerosolization zone. As used herein, the term "reservoir" refers to a receptacle or chamber for holding, storing, or retaining a product such as a liquid, fluid, or aerosol. One such example is shown in FIG. 1. As seen therein, the cartridge 90 includes a reservoir layer 201 comprising layers of nonwoven fibers formed into the shape of a tube encircling the interior of the cartridge shell 91, in this embodiment. An aerosol precursor composition is retained in the reservoir layer 201. Liquid components, for example, can be sorptively retained by the reservoir layer 201. The reservoir layer 201 is in fluid connection with a transport element 301 (a wick in this embodiment). The transport element 301 transports the aerosol precursor composition stored in the reservoir layer 201 via capillary action to an aerosolization zone 400 of the cartridge 90. As illustrated, the transport element 301 is in direct contact with the resistive heating element 50 that is in the form of a metal wire coil in this embodiment.

In use, when a user draws on the article 10, the resistive heating element 50 is activated (e.g., such as via a puff sensor), and the components for the aerosol precursor composition are vaporized in the aerosolization zone 400. Drawing upon the mouthend 11 of the article 10 causes ambient air to enter the air intake 17 and pass through the central opening in the receptacle 60 and the central opening in the plug 65. In the cartridge 90, the drawn air passes through an air passage 230 in an air passage tube 220 and combines with the formed vapor in the aerosolization zone 400 to form an aerosol. The aerosol is whisked away from the aerosolization zone, passes through an air passage 260 in an air passage tube 250, and out the mouth opening 18 in the mouthend 11 of the article 10. If desired, the air passage tube 250 can be absent, and an open cavity may reside in the location for formation of aerosol as the aerosol precursor composition is vaporized by the resistive heating element 50.

The smoking article 10 in the embodiment illustrated in FIG. 1 can be characterized as a disposable article. Accordingly, it can be desirable for the reservoir 201 in such embodiments to include a sufficient amount of aerosol precursor composition and any further inhalable materials so that a consumer can obtain more than a single use of the smoking article. For example, the smoking article can include sufficient aerosolizable and/or inhalable materials such that the smoking article can provide a number of puffs substantially equivalent to the number of puffs (of about two seconds duration) available from a plurality of conventional cigarettes—e.g., 2 or more, 5 or more, 10 or more, or 20 or more conventional cigarettes. More particularly, a disposable, single unit article according to the embodiment of FIG. 1 can provide about 20 or more, about 50 or more, or about 100 or more puffs.

Although FIG. 1 is illustrative of a smoking article according to the present disclosure, the scope of the disclosure should not be viewed as being limited to the specific combination and/or arrangement of components illustrated therein. Rather, the present disclosure can encompass a variety of combinations of components useful in forming an electronic smoking article. Reference is made for example to the smoking articles disclosed in U.S. patent application Ser. No. 13/536,438, filed Jun. 28, 2012, and U.S. patent application Ser. No. 13/432,406, filed Mar. 28, 2012, the disclosures of which are incorporated herein by reference in their entirety. Further to the above, representative heating element and materials for use therein are described in U.S. Pat. No. 5,060,671 to Counts et al.; U.S. Pat. No. 5,093,894 to Deevi et al.; U.S. Pat. No. 5,224,498 to Deevi et al.; U.S. Pat. No. 5,228,460 to Sprinkel Jr., et al.; U.S. Pat. No. 5,322,075 to Deevi et al.; U.S. Pat. No. 5,353,813 to Deevi et al.; U.S. Pat. No. 5,468,936 to Deevi et al.; U.S. Pat. No. 5,498,850 to Das; U.S. Pat. No. 5,659,656 to Das; U.S. Pat. No. 5,498,855 to Deevi et al.; U.S. Pat. No. 5,530,225 to Hajaligol; U.S. Pat. No. 5,665,262 to Hajaligol; U.S. Pat. No. 5,573,692 to Das et al.; and U.S. Pat. No. 5,591,368 to Fleischhauer et al., the disclosures of which are incorporated herein by reference in their entireties.

The various components of a smoking article according to the present invention can be chosen from components described in the art and commercially available. Examples of batteries that can be used according to the disclosure are described in US Pub. App. No. 2010/0028766, the disclosure of which is incorporated herein by reference in its entirety.

An exemplary mechanism that can provide puff-actuation capability includes a Model 163PC01D36 silicon sensor, manufactured by the MicroSwitch division of Honeywell, Inc., Freeport, Ill. Further examples of demand-operated electrical switches that may be employed in a heating circuit according to the present disclosure are described in U.S. Pat. No. 4,735,217 to Gerth et al., which is incorporated herein by reference in its entirety. Further description of current regulating circuits and other control components, including microcontrollers, that can be useful in the present smoking article are provided in U.S. Pat. Nos. 4,922,901, 4,947,874, and 4,947,875, all to Brooks et al., U.S. Pat. No. 5,372,148 to McCafferty et al., U.S. Pat. No. 6,040,560 to Fleischhauer et al., and U.S. Pat. No. 7,040,314 to Nguyen et al., all of which are incorporated herein by reference in their entireties.

The aerosol precursor, which may also be referred to as a vapor precursor composition, can comprise one or more different components. For example, the aerosol precursor can include a polyhydric alcohol (e.g., glycerin, propylene glycol, or a mixture thereof). Representative types of further aerosol precursor compositions are set forth in U.S. Pat. No. 4,793,365 to Sensabaugh, Jr. et al.; U.S. Pat. No. 5,101,839 to Jakob et al.; PCT WO 98/57556 to Biggs et al.; and Chemical and Biological Studies on New Cigarette Prototypes that Heat Instead of Burn Tobacco, R. J. Reynolds Tobacco Company Monograph (1988); the disclosures of which are incorporated herein by reference.

Aerosol precursor compositions can include further liquid materials, such as water. For example, aerosol precursor compositions can incorporate mixtures of glycerin and water, or mixtures of propylene glycol and water, or mixtures of propylene glycol and glycerin, or mixtures of propylene glycol, glycerin, and water. Exemplary aerosol precursor compositions also include those types of materials incorporated within devices available through Atlanta Imports Inc., Acworth, Ga., USA., as an electronic cigar having the brand name E-CIG, which can be employed using associated Smoking Cartridges Type C1a, C2a, C3a, C4a, C1b, C2b, C3b and C4b; and as Ruyan Atomizing Electronic Pipe and Ruyan Atomizing Electronic Cigarette from Ruyan SBT Technology and Development Co., Ltd., Beijing, China. Exemplary formulations for aerosol precursor compositions that may be used according to the present disclosure are described in U.S. Pat. Pub. No. 2013/0008457 to Zheng et al., the disclosure of which is incorporated herein by reference in its entirety.

The aerosol precursor composition used in the disclosed smoking article further can comprise one or more flavors, medicaments, or other inhalable materials. For example, liquid nicotine can be used. Such further materials can comprise one or more components of the aerosol precursor or vapor precursor composition. Thus, the aerosol precursor or vapor precursor composition can be described as comprising an inhalable substance. Such inhalable substance can include flavors, medicaments, and other materials as discussed herein. Particularly, an inhalable substance delivered using a smoking article according to the present invention can comprise a tobacco component or a tobacco-derived material. Alternately, the flavor, medicament, or other inhalable material can be provided separate from other aerosol precursor components—e.g., in a reservoir. As such, defined aliquots of the flavor, medicament, or other inhalable material may be separately or simultaneously delivered to the resistive heating element to release the flavor, medicament, or other inhalable material into an air stream to be inhaled by a user along with the further components of the aerosol precursor or vapor precursor composition.

A wide variety of types of flavoring agents, or materials that alter the sensory or organoleptic character or nature of the mainstream aerosol of the smoking article, can be employed. Such flavoring agents can be provided from sources other than tobacco, can be natural or artificial in nature, and can be employed as concentrates or flavor packages. Of particular interest are flavoring agents that are applied to, or incorporated within, those regions of the smoking article where aerosol is generated. Again, such agents can be supplied directly to the resistive heating element or may be provided on a substrate as already noted above. Exemplary flavoring agents include vanillin, ethyl vanillin, cream, tea, coffee, fruit (e.g., apple, cherry, strawberry, peach and citrus flavors, including lime and lemon), maple, menthol, mint, peppermint, spearmint, wintergreen, nutmeg, clove, lavender, cardamom, ginger, honey, anise, sage, cinnamon, sandalwood, jasmine, cascarilla, cocoa, licorice, and flavorings and flavor packages of the type and character traditionally used for the flavoring of cigarette, cigar, and pipe tobaccos. Syrups, such as high fructose corn syrup, also can be employed. Flavoring agents also can include acidic or basic characteristics (e.g., organic acids, such as levulinic acid, succinic acid, lactic acid, and pyruvic acid). The flavoring agents can be combined with the aerosol-generating material if desired. Exemplary plant-derived compositions that may be used are disclosed in US Pat. Pub. No. 2012/0152265 to Dube et al. and US Pat. Pub. No. 2012/0192880 to Dube et al., the disclosures of which are incorporated herein by reference in their entireties.

Organic acids particularly may be incorporated into the aerosol precursor to provide desirable alterations to the flavor, sensation, or organoleptic properties of medicaments, such as nicotine, that may be combined with the aerosol precursor. For example, organic acids, such as levulinic acid, succinic acid, lactic acid, and pyruvic acid, may be included in the aerosol precursor with nicotine in amounts up to being equimolar (based on total organic acid content) with the nicotine. Any combination of organic acids can be used. For example, the aerosol precursor can include about 0.1 to about 0.5 moles of levulinic acid per one mole of nicotine, about 0.1 to about 0.5 moles of pyruvic acid per one mole of nicotine, about 0.1 to about 0.5 moles of lactic acid per one mole of nicotine, or combinations thereof, up to a concentration wherein the total amount of organic acid present is equimolar to the total amount of nicotine present in the aerosol precursor.

In embodiments of the aerosol precursor material that contain a tobacco extract, including pharmaceutical grade nicotine derived from tobacco, it is advantageous for the tobacco extract to be characterized as substantially free of compounds collectively known as Hoffmann analytes, including, for example, tobacco-specific nitrosamines (TSNAs), including N'-nitrosonornicotine (NNN), (4-methylnitrosamino)-1-(3-pyridyl)-1-butanone (NNK), N'-nitrosoanatabine (NAT), and N'-nitrosoanabasine (NAB); polyaromatic hydrocarbons (PAHs), including benz[a]anthracene, benzo[a]pyrene, benzo[b]fluoranthene, benzo[k]fluoranthene, chrysene, dibenz[a,h]anthracene, and indeno[1,2,3-cd]pyrene, and the like. In certain embodiments, the aerosol precursor material can be characterized as completely free of any Hoffmann analytes, including TSNAs and PAHs. Embodiments of the aerosol precursor material may have TSNA levels (or other Hoffmann analyte levels) in the range of less than about 5 ppm, less than about 3 ppm, less than about 1 ppm, or less than about 0.1 ppm, or even below any detectable limit. Certain extraction processes or treatment processes can be used to achieve reductions in Hoffmann analyte concentration. For example, a tobacco extract can be brought into contact with an imprinted polymer or non-imprinted polymer such as described, for example, in US Pat. Pub. Nos. 2007/0186940 to Bhattacharyya et al; 2011/0041859 to Rees et al.; and 2011/0159160 to Jonsson et al; and U.S. patent application Ser. No. 13/111,330 to Byrd et al., filed May 19, 2011, all of which are incorporated herein by reference. Further, the tobacco extract could be treated with ion exchange materials having amine functionality, which can remove certain aldehydes and other compounds. See, for example, U.S. Pat. No. 4,033,361 to Horsewell et al. and U.S. Pat. No. 6,779,529 to Figlar et al., which are incorporated herein by reference in their entireties.

In certain embodiments, the aerosol precursor can be adapted to increase in surface area during heating for aerosol formation in an electronic smoking article. In particular, the aerosol precursor can comprise an effervescent material. The effervescent material can be adapted to degrade during heating and release carbon dioxide (or other gaseous substance) sufficient to cause foaming of at least a portion of the aerosol precursor or to produce fine droplets. Inclusion of such effervescent can be beneficial to reduce the amount of heat needed to form an aerosol from the aerosol precursor.

The aerosol precursor composition may take on a variety of conformations based upon the various amounts of materials utilized therein. For example, a useful aerosol precursor composition may comprise up to about 98% by weight up to about 95% by weight, or up to about 90% by weight of a polyol. This total amount can be split in any combination between two or more different polyols. For example, one polyol can comprise about 50% to about 90%, about 60% to about 90%, or about 75% to about 90% by weight of the aerosol precursor, and a second polyol can comprise about 2% to about 45%, about 2% to about 25%, or about 2% to about 10% by weight of the aerosol precursor. A useful aerosol precursor also can comprise up to about 25% by weight, about 20% by weight or about 15% by weight water—particularly about 2% to about 25%, about 5% to about 20%, or about 7% to about 15% by weight water. Flavors and the like (which can include medicaments, such as nicotine) can comprise up to about 10%, up to about 8%, or up to about 5% by weight of the aerosol precursor.

As a non-limiting example, an aerosol precursor according to the invention can comprise glycerol, propylene glycol, water, nicotine, and one or more flavors. Specifically, the glycerol can be present in an amount of about 70% to about 90% by weight, about 70% to about 85% by weight, or about 75% to about 85% by weight, the propylene glycol can be present in an amount of about 1% to about 10% by weight, about 1% to about 8% by weight, or about 2% to about 6% by weight, the water can be present in an amount of about 10% to about 20% by weight, about 10% to about 18% by weight, or about 12% to about 16% by weight, the nicotine can be present in an amount of about 0.1% to about 5% by weight, about 0.5% to about 4% by weight, or about 1% to about 3% by weight, and the flavors can be present in an amount of up to about 5% by weight, up to about 3% by weight, or up to about 1% by weight, all amounts being based on the total weight of the aerosol precursor. One specific, non-limiting example of an aerosol precursor comprises about 75% to about 80% by weight glycerol, about 13% to about 15% by weight water, about 4% to about 6% by weight propylene glycol, about 2% to about 3% by weight nicotine, and about 0.1% to about 0.5% by weight flavors. The nicotine, for example, can be from a tobacco extract.

The amount of aerosol precursor composition that is used within the smoking article is such that the article exhibits acceptable sensory and organoleptic properties, and desirable performance characteristics. For example, it is highly preferred that sufficient aerosol precursor composition components, such as glycerin and/or propylene glycol, be employed in order to provide for the generation of a visible mainstream aerosol that in many regards resembles the appearance of tobacco smoke. Typically, the amount of aerosol-generating material incorporated into the smoking article is in the range of about 1.5 g or less, about 1 g or less, or about 0.5 g or less. The amount of aerosol precursor composition can be dependent upon factors such as the number of puffs desired per cartridge used with the smoking article. It is desirable for the aerosol precursor composition not to introduce significant degrees of unacceptable off-taste, filmy mouth-feel, or an overall sensory experience that is significantly different from that of a traditional type of cigarette that generates mainstream smoke by burning tobacco cut filler. The selection of the particular aerosol-generating material and reservoir material, the amounts of those components used, and the types of tobacco material used, can be altered in order to control the overall chemical composition of the mainstream aerosol produced by the smoking article.

Still further components can be utilized in the smoking article of the present disclosure. For example, U.S. Pat. No. 5,261,424 to Sprinkel, Jr. discloses piezoelectric sensors that can be associated with the mouth-end of a device to detect user lip activity associated with taking a draw and then trigger heating; U.S. Pat. No. 5,372,148 to McCafferty et al. discloses a puff sensor for controlling energy flow into a heating load array in response to pressure drop through a mouthpiece; U.S. Pat. No. 5,967,148 to Harris et al. discloses receptacles in a smoking device that include an identifier that detects a non-uniformity in infrared transmissivity of an inserted component and a controller that executes a detection routine as the component is inserted into the receptacle; U.S. Pat. No. 6,040,560 to Fleischhauer et al. describes a defined executable power cycle with multiple differential phases; U.S. Pat. No. 5,934,289 to Watkins et al. discloses photonic-optronic components; U.S. Pat. No. 5,954,979 to Counts et al. discloses means for altering draw resistance through a smoking device; U.S. Pat. No. 6,803,545 to Blake et al. discloses specific battery configurations for use in smoking devices; U.S. Pat. No. 7,293,565 to Griffen et al. discloses various charging systems for use with smoking devices; US 2009/0320863 by Fernando et al. discloses computer interfacing means for smoking devices to facilitate charging and allow computer control of the device; US 2010/0163063 by Fernando et al. discloses identification systems for smoking devices; and WO 2010/003480 by Flick discloses a fluid flow sensing system indicative of a puff in an aerosol generating system; all of the foregoing disclosures being incorporated herein by reference in their entireties. Further examples of components related to electronic aerosol delivery articles and disclosing materials or components that may be used in the present article include U.S. Pat. No. 4,735,217 to Gerth et al.; U.S. Pat. No. 5,249,586 to Morgan et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,896,006 to Hamano; U.S. Pat. No. 6,772,756 to Shayan; US Pat. Pub. Nos. 2009/0095311, 2006/0196518, 2009/0126745, and 2009/0188490 to Hon; US Pat. Pub. No. 2009/0272379 to Thorens et al.; US Pat. Pub. Nos. 2009/

0260641 and 2009/0260642 to Monsees et al.; US Pat. Pub. Nos. 2008/0149118 and 2010/0024834 to Oglesby et al.; US Pat. Pub. No. 2010/0307518 to Wang; US Pat. Pub. No. 2013/0037041 to Worm et al.; and WO 2010/091593 to Hon. A variety of the materials disclosed by the foregoing documents may be incorporated into the present devices in various embodiments, and all of the foregoing disclosures are incorporated herein by reference in their entireties.

Although an article according to the disclosure may take on a variety of embodiments, as discussed in detail below, the use of the article by a consumer will be similar in scope. In particular, the article can be provided as a single unit or as a plurality of components that are combined by the consumer for use and then are dismantled by the consumer thereafter. Generally, a smoking article according to the disclosure can comprise a first unit that is engagable and disengagable with a second unit, the first unit comprising the resistive heating element, and the second unit comprising the electrical power source. In some embodiments, the second unit further can comprise one or more control components that actuate or regulate current flow from the electrical power source. The first unit can comprise a distal end that engages the second unit and an opposing, proximate end that includes a mouthpiece (or simply the mouthend) with an opening at a proximate end thereof. The first unit can comprise an air flow path opening into the mouthpiece of the first unit, and the air flow path can provide for passage of aerosol formed from the resistive heating element into the mouthpiece. In preferred embodiments, the first unit can be disposable. Likewise, the second unit can be reusable.

During use, the consumer initiates heating of the resistive heating element, the heat produced by the resistive heating element aerosolizes the aerosol precursor composition and, optionally, further inhalable substances. Such heating releases at least a portion of the aerosol precursor composition in the form of an aerosol (which can include any further inhalable substances included therewith), and such aerosol is provided within a space inside the cartridge that is in fluid communication with the mouthend of the cartridge. When the consumer inhales on the mouth end of the cartridge, air is drawn through the cartridge, and the combination of the drawn air and the aerosol is inhaled by the consumer as the drawn materials exit the mouth end of the cartridge (and any optional mouthpiece present) into the mouth of the consumer. To initiate heating, the consumer may actuate a pushbutton, capacitive sensor, or similar component that causes the resistive heating element to receive electrical energy from the battery or other energy source (such as a capacitor). The electrical energy may be supplied for a pre-determined length of time or may be manually controlled. Preferably, flow of electrical energy does not substantially proceed in between puffs on the article (although energy flow may proceed to maintain a baseline temperature greater than ambient temperature—e.g., a temperature that facilitates rapid heating to the active heating temperature). In further embodiments, heating may be initiated by the puffing action of the consumer through use of various sensors, as otherwise described herein. Once the puff is discontinued, heating will stop or be reduced. When the consumer has taken a sufficient number of puffs so as to have released a sufficient amount of the inhalable substance (e.g., an amount sufficient to equate to a typical smoking experience), the cartridge can be removed from the control housing and discarded. Indication that the cartridge is spent (i.e., the aerosol precursor composition has been substantially removed by the consumer) can be provided. In some embodiments, a single cartridge can provide more than a single smoking experience and thus may provide a sufficient content of aerosol precursor composition to simulate as much as full pack of conventional cigarettes or even more.

The foregoing description of use of the article can be applied to the various embodiments described through minor modifications, which can be apparent to the person of skill in the art in light of the further disclosure provided herein. The above description of use, however, is not intended to limit the use of the article but is provided to comply with all necessary requirements of disclosure of the present disclosure.

In various embodiments, the present disclosure particularly can provide a reservoir that can be easily combined with further elements of a smoking article, particularly a cartridge. For example, FIG. 2 provides a cut-away view of a cartridge 500 that can be included in an electronic smoking article. The cartridge 500 includes a reservoir 501 according to one embodiment. The cartridge 500 can be substantially tubular in shape and can be formed of a reservoir wall 502 as described herein. As illustrated, the reservoir 501 can be in the general shape of a substantially hollow tube that is concentric with the cartridge wall 502. The reservoir 501 can be substantially rod-like or substantially tubular shaped or substantially cylindrically shaped. Thus, the reservoir 501 can have a diameter such that the reservoir 501 can be adapted to fit within the cartridge 500. The reservoir 501 can be formed from a plurality of combined layers that can be concentric or overlapping. For example, the reservoir 501 can be a continuous sheet of material that is rolled to form the hollow tube. The reservoir also may be a mat of nonwoven material. In other embodiments, the reservoir 501 can be substantially a unitary component. For example, the reservoir 501 can be shaped or molded so as to be a singular element in the form of a substantially hollow tube that is substantially continuous in composition across the length and thickness thereof. The reservoir 501 can be rigid or semi-rigid. The reservoir 501 can include a first end 503 and an opposing second end 504. The reservoir 501 includes an exterior surface 505 that can be substantially shaped and adapted to conform to an interior surface 506 of cartridge wall 502. If desired, one or more additional components of a smoking article according to the present disclosure can be accommodated within or around the reservoir 501. While the reservoir 501 is shown in the cartridge 500 portion of a smoking article in FIG. 2, one skilled in the art will appreciate that the reservoir 501 can be positioned within any portion of a smoking article so as not to impede the storage and delivery of an aerosol precursor composition stored therein.

In certain embodiments, a reservoir according to the present disclosure can be provided in a form such that at least part of the hollow interior thereof is shaped and dimensioned to accommodate one or more further components of the smoking article. In some embodiments, the term "shaped and dimensioned" can indicate that a wall of the hollow interior includes one or more indentations or protrusions that cause the interior to have a shape that is other than substantially smooth and continuous. In other embodiments, the hollow nature of the reservoir can be sufficient to allow for accommodation of further components of the smoking article without the need for formation of cavities or protrusions.

The articles of the present disclosure can be particularly beneficial in that the reservoir can be pre-formed and can have a hollow interior with a wall that is shaped and dimensioned to accommodate a further component of the smoking article in a mating arrangement. This particularly can facilitate ease of assembly of the smoking article and can maximize the reservoir volume while also providing sufficient space for aerosol formation. One embodiment of a cartridge according to the present disclosure is shown in FIG. 3, which provides an exploded view of a cartridge 500. As seen therein, a cartridge wall 502 can be adapted to enclose a reservoir 501 as described herein. The exterior surface 505 of the reservoir 501 can be adapted to conform to the interior surface 506 of the cartridge wall 502.

The reservoir 501 also has an inner surface 508 that defines a central cavity 507 of the reservoir. In the illustrated embodiment, the inner surface 508 of the reservoir 501 includes two diametrically opposed grooves (515, 516) that extend inward into the reservoir from the central cavity. As illustrated, the grooves extend substantially the entire length of the reservoir 501 from the first end 503 to the second end 504 thereof. In other embodiments, the grooves may be absent, and the inner surface of the reservoir still may be characterized as being shaped and dimensioned to accommodate an atomizer in that the atomizer can be positioned with the central cavity such that a portion of the atomizer is in fluid connection with the reservoir.

In the embodiment of FIG. 3, the atomizer specifically comprises a heater, a liquid transport element, and electrically conducting terminals. As illustrated in FIG. 3, the liquid transport element is a continuous, elongated wick 509, and the heater is a resistive heating coil 510 that is in connection with the wick and is positioned at about a midpoint of the wick. The portions of the wick extending beyond the resistive heating coil can be referred to as distal arms of the wick. The electrically conducting terminals 511 of the atomizer 520 are positioned in contact with the wick 509 distal to the resistive heating coil 510. The electrically conducting terminals particularly can be characterized as being in contact with the wick at one or more portions of the wick distal to the resistive heating coil. As illustrated, the electrically conducting terminals 511 extend beyond the ends of the wick 509. Such extension is not necessarily required. In light of the nature of the reservoir 501 with its hollow interior portion, an atomizer can be easily positioned interior to the reservoir during assembly of the smoking article. Likewise, as the hollow interior can be shaped and dimensioned to mate with the atomizer, the combination can be easily assembled, and the atomizer can snugly mate with the reservoir while simultaneously placing the wick in fluid connection with the reservoir.

The above configuration is further illustrated in FIG. 4, which provides a perspective view of a reservoir 501 according one embodiment having an atomizer 520 combined therewith. The reservoir 501 includes a central cavity 507 that can be devoid of fibrous material and capable of storing, holding, or retaining a product such as an aerosol precursor composition. The atomizer 520 is combined with the reservoir 501 in that the distal arms of the wick 509 are mated with and engaging the diametrically opposed grooves (515, 516). The grooves may be pre-formed in the reservoir or the grooves may be formed by the engagement of the atomizer wick with the inner walls of the reservoir such that the fibrous reservoir is locally compressed by the atomizer wick. By adapting the inner surface 508 of the central cavity 507 of the reservoir 501 to accommodate the various smoking article components, available open space in the smoking article can be fully maximized by extending the reservoir 501 into the previously open spaces. As a result, the overall size and capacity of the reservoir 501 can be increased in comparison to traditional woven or non-woven fiber mats that are typically utilized in electronic smoking articles. The increased capacity allows the reservoir 501 to hold an increased amount of aerosol precursor composition which, in turn, results in longer use and enjoyment of the smoking article by the end user.

As illustrated in FIG. 4, the portion of the atomizer 520 comprising the resistive heating element extends beyond the second end 504 of the reservoir 501. When assembled with a cartridge, the second end 504 of the reservoir 501 can be positioned proximate to a mouthend (see element 11 in FIG. 1) of the cartridge. Desirably, the mouthend of the cartridge can include an open cavity wherein aerosol can be formed as the aerosol precursor composition is vaporized by the resistive heating element. In other embodiments, it is not necessary for the atomizer to extend beyond the end of the reservoir, and the atomizer can be positioned relative to the reservoir such that the resistive heating element is within the hollow cavity of the reservoir.

The reservoir can be manufactured from any material capable of being shaped into a rigid or semi-rigid hollow tube while retaining the ability to store a liquid product such as, for example, an aerosol precursor composition. In certain embodiments, the reservoir material can be absorbent, adsorbent, or otherwise porous so as to provide the ability to retain the aerosol precursor composition. As such, the aerosol precursor composition can be characterized as being coated on, adsorbed by, or absorbed in the reservoir material. The reservoir can be positioned within the smoking article to be in substantial contact with one or more transport elements (e.g., wicks). More particularly, a reservoir can be manufactured from any material suitable for retaining the aerosol precursor composition (e.g., through absorption, adsorption, or the like) and allowing wicking away of the precursor composition for transport to the resistive heating element.

The reservoir material is suitable for forming and maintaining an appropriate conformation, such as a substantially tubular shape, and for accommodating therein the suitable components of the smoking article. The reservoir material can be heat resistant so as to retain its structural integrity—e.g., does not degrade—at least at a temperature that is received in a position proximal to the heating temperature provided by the resistive heating element. The size and strength of the reservoir may vary according to the features and requirements of the corresponding electronic smoking article. In particular embodiments, the reservoir can be manufactured from a material suitable for a high-speed, automated manufacturing process. In certain embodiments, the reservoir can comprise a woven or non-woven fibrous mat, which may be rolled or otherwise formed into a tube or hollow cylinder shape. In other embodiments, the reservoir can be a molded tube or hollow cylinder.

According to one embodiment, the reservoir can be manufactured from a cellulose acetate tow which can be processed to form a hollow acetate tube. Cellulose acetate tow can be prepared according to various processes known to one skilled in the art. See, for example, the processes forth in U.S. Pat. No. 4,439,605 to Yabune, U.S. Pat. No. 5,167,764 to Nielsen et al., and U.S. Pat. No. 6,803,458 to Ozaki which are incorporated herein by reference in their entireties. Typically, cellulose acetate is derived from cellulose by reacting purified cellulose from wood pulp with acetic acid and acetic anhydride in the presence of sulfuric acid. The resulting product is then put through a controlled, partial hydrolysis to remove the sulfate and a sufficient number of acetate groups to produce the required properties for a cellulose acetate that is capable of ultimately forming a rigid or semi-rigid hollow tube. Cellulose acetate can then be extruded, spun, and arranged into a tow. The cellulose acetate fibers can be opened, crimped, or a continuous filament.

In further embodiments, the cellulose acetate can be any acetate material of the type that can be employed for providing a tobacco smoke filter for cigarettes. Preferably a traditional cigarette filter material is used, such as cellulose acetate tow, gathered cellulose acetate web, or gathered cellulose acetate web. Examples of materials that can be used as an alternative to cellulose acetate include polypropylene tow, gathered paper, strands of reconstituted tobacco, or the like. One filter material that can provide a suitable filter rod and thus a suitable hollow tube reservoir is cellulose acetate tow having 3 denier per filament and 40,000 total denier. As another example, cellulose acetate tow having 3 denier per filament and 35,000 total denier can be used. As another example, cellulose acetate tow having 8 denier per filament and 40,000 total denier can be used. For further examples, see the types of filter materials set forth in U.S. Pat. No. 3,424,172 to Neurath; U.S. Pat. No. 4,811,745 to Cohen et al.; U.S. Pat. No. 4,925,602 to Hill et al.; U.S. Pat. No. 5,225,277 to Takegawa et al. and U.S. Pat. No. 5,271,419 to Arzonico et al.; each of which is incorporated herein by reference.

Cellulose acetate fibers can be mixed with other materials, such as, cellulose, viscose, cotton, cellulose acetate-butyrate, cellulose propionate, polyester—e.g., polyethylene terephthalate (PET), polylactic acid (PLA), activated carbon, glass fibers, metal fibers, wood fibers, and the like. The fibers of a cellulose acetate tow emerging from the spinneret can be bunched together to form a "raw tow" which can be collected into a bale for subsequent processing into a tube as described herein. Additional examples of fiber materials that can be suitable for use in a reservoir according to the present disclosure are described in US Pat Publication No. 2013/0025610 to Sebastian et al., the disclosure of which is incorporated herein by reference.

Cellulose acetate can be processed and formed into a tube using conventional filter tow processing means. For example, a steam bonding process can be used to produce the hollow acetate tubes. Exemplary processes for forming tubes of cellulose acetate can be found US Pat. Publication No. 2012/0255569 to Beard et al. In further embodiments, cellulose acetate can be processed using a conventional filter tow processing unit. For example, filter tow can be bloomed using bussel jet methodologies or threaded roll methodologies. An exemplary tow processing unit has been commercially available as E-60 supplied by Arjay Equipment Corp., Winston-Salem, N.C. Other exemplary tow processing units have been commercially available as AF-2, AF-3 and AF-4 from Hauni-Werke Korber & Co. KG. and as Candor-ITM Tow Processor from International Tobacco Machinery. Other types of commercially available tow processing equipment, as are known to those of ordinary skill in the art, can be employed. Alternative materials for forming the hollow tube reservoir, such as gathered paper, nonwoven polypropylene web, or gathered strands of shredded web, can be provided using the types of materials, equipment and techniques set forth in U.S. Pat. No. 4,807,809 to Pryor et al. and U.S. Pat. No. 5,025,814 to Raker. In addition, representative manners and methods for operating a filter material supply units and filter-making units are set forth in U.S. Pat. No. 4,281,671 to Bynre; U.S. Pat. No. 4,850,301 to Green, Jr. et al.; U.S. Pat. No. 4,862,905 to Green, Jr. et al.; U.S. Pat. No. 5,060,664 to Siems et al.; U.S. Pat. No. 5,387,285 to Rivers and U.S. Pat. No. 7,074,170 to Lanier, Jr. et al.

The hollow acetate tubes as described herein can be particularly useful because of a surprisingly efficient liquid storing capacity. According to one embodiment, the cellulose acetate tow can have a linear mass density of about 0.5 denier per filament (dpf) or greater, about 1 dpf or greater, or about 2 dpf or greater. In other embodiments, the cellulose acetate tow can have a linear mass density of about 0.5 dpf to about 20 dpf, about 0.75 dpf to about 15 dpf, about 1 dpf to about 10 dpf, or about 2 dpf to about 6 dpf. The cellulose acetate used according to the present disclosure can comprise staple fibers. The stable fibers can have an average length of about 0.1 in. to about 6 in., about 0.2 in. to about 5 in. or about 0.25 in. to about 3 in.

The reservoir comprising cellulose acetate can be formed of various compositions and in various manners. In particular embodiments, the reservoir can comprise cellulose acetate fibers. If desired, the reservoir can comprise a binder. Fillers (e.g., cellulose) and fibers formed of different materials also can be used. The reservoir can comprise about 70% to about 99% by weight cellulose acetate fibers, and the weights noted herein are measured on a dry weight basis. More specifically, the reservoir can comprise about 75% to about 98%, about 80% to about 97.5%, or about 90% to about 97% by weight cellulose acetate fibers. The reservoir can comprise about 1% to about 30% by weight of the binder. More specifically, the reservoir can comprise about 2% to about 25%, about 2.5% to about 20%, or about 3% to about 10% by weight of the binder. In specific embodiments, a reservoir according to the disclosure can comprise about 95% to about 97% by weight cellulose acetate fiber and about 3% to about 5% by weight binder. In other specific embodiments, a reservoir according to the disclosure can comprise about 80% to about 85% by weight cellulose acetate fiber and about 15% to about 20% by weight binder. A binder is understood to be a material that imparts a cohesive effect to the fibers used in forming the disclosed reservoirs. For example, the binder can be a material that partially solubilizes the cellulose acetate fibers such that the fibers bind to each other or to further fibrous materials included in the woven or non-woven reservoir. Exemplary binders that can be used include polyvinyl acetate (PVA) binders, starch, and triacetin. One of skill in the art of cigarette filter manufacture may recognize triacetin as being a plasticizer for such filters. As such, it is understood that there may be overlap between the group of binders useful according to the present disclosure and materials that may be recognized in further arts as plasticizers. Accordingly, the cohesion agent used and described herein as a binder may encompass materials that may be recognized in other fields as being plasticizers. Moreover, materials recognized in the field of cigarette filters as plasticizers for cellulose acetate may be encompassed by the use of the term binders herein.

The cellulose acetate fibers can have various cross-sectional shapes—e.g., round, elongated, or multi-lobal. In specific embodiments, cellulose acetate having a tri-lobal or Y-shaped cross-sectional shape can be used.

In some embodiments, a non-woven fibrous mat reservoir according to the present disclosure can be formed by a wet-laid process or by a dry-laid process. When using a wet-laid process, it can be beneficial to use cellulose acetate fibers having shorter lengths—e.g., in the range of about 0.25 in. to about 2 in. When using a dry-laid process, it can be beneficial to use cellulose acetate fibers having longer lengths—e.g., in the range of about 2.5 in. to about 3 in. In each case, a resulting mat comprising the cellulose acetate fibers can be at a thickness of about 1 mm to about 4 mm, about 1.25 mm to about 3.5 mm, or about 1.5 mm to about 3 mm. The cellulose acetate mat can have a basis weight of about 70 grams per square meter (gsm) to about 240 gsm, about 80 gsm to about 220 gsm, or about 90 gsm to about 200 gsm. The cellulose acetate mat can be sized to a desired width. In various embodiments, the width can be about 10 mm to about 25 mm, about 15 mm to about 24 mm, or about 20 mm to about 23 mm. The cellulose acetate mats can be cut to lengths suitable to be rolled into a tube having an outer diameter suitable for insertion into a smoking article as described herein and having an inner diameter suitable to allow insertion of an atomizer therein according to the present disclosure. The ends of the rolled mats can form a butt joint or may overlap. In further embodiments, the cellulose acetate composition can be molded into a formed shape that is substantially tubular. The shaped hollow acetate tube can have one or more shapes formed into the inner wall thereof, such as the diametrically opposed grooves discussed above.

In some embodiments, the fibers of the formed mats can be entangled. For example, hydroentangling and needle punching each can be used separately or in combination. In specific embodiments, needle punching can be used with at least 250, at least 500, at least 1,000, or at least 1,500 needle punches per square inch (NPPSI). In particular, about 250 to about 2,500, about 500 to about 2,000, or about 750 to about 1,500 NPPSI can be used.

According to one embodiment, the reservoir can comprise a mixture of different types of fibers. Suitable fibers for forming such mixture include, but are not limited to, fibers formed from cellulose acetate, wood pulp, wool, silk, polyesters (e.g., polyethylene terephthalate) polyamides (e.g., nylons), polyolefins, polyvinyl alcohol, and the like.

It has been found according to the present disclosure that hydrophilic fibers, particularly cellulose acetate, can be particularly useful in forming a reservoir for an aerosol precursor composition, particularly a composition formed predominately with a polyhydric alcohol, such as glycerin. Such reservoirs can provide improved storage and release of the aerosol precursor composition. For example, such reservoirs can provide for faster loading of the aerosol precursor composition, for more consistent release of the aerosol precursor composition when drawn away, such as by a wick, during use of the smoking article, and a reduction in the total volume of aerosol precursor composition that must be loaded in the reservoir.

The filaments used in a wick according to the present disclosure can be formed of any material that provides sufficient wicking action to transport one or more components of the aerosol precursor composition along the length of the filament. Non-limiting examples include natural and synthetic fibers, such as cotton, cellulose, polyesters, polyamides, polylactic acids, glass fibers, combinations thereof, and the like. Other exemplary materials that can be used in wicks include metals, ceramics, and carbonized filaments (e.g., a material formed of a carbonaceous material that has undergone calcining to drive off non-carbon components of the material).

The filaments (or the wick generally) can be coated with materials that alter the capillary action of the filaments—i.e., to increase (or decrease, if desired) the wicking action of the filament. Also, fiber material selection can be utilized to increase or decrease wicking action and thus control the wicking rate of a specific component of the aerosol precursor composition. Wicking also can be customized through choice of the dimensions of the fibers used in the wicks and the overall dimensions of the wick, including wick length and wick diameter.

The filaments used in forming wicks can have specific cross-sectional shape and/or can be grooved so as to alter the capillary action of the fibers. Typical filaments have a substantially round cross-section, and altering fiber cross-section shape can increase the surface area per denier of the fiber and thus improve wicking along the filament. For example, a filament can be formed with longitudinal grooves that are intended to facilitate wicking, such as a 4DG fiber (available from Fiber Innovation Technology) and winged fibers (available from Alasso Industries). Filaments formed with an "X" or "Y" shaped cross-section similarly can provide desirable wicking properties.

In other embodiments, at least a portion of a filament utilized in a wick can be designed to promote radial wicking. Continuous filament fibers, such as fiberglass, tend to promote wicking primarily along the axis of the filament—i.e., axial wicking. Through appropriate design, the filament also can be caused to promote radial wicking—i.e., outward from the axis of the filament. For example, radial wicking can be facilitated through use of filaments having a fibrillated fiber surface. Such design particularly can be useful in the area of the filaments that are in proximity to or in contact with the heater as it can cause more of the precursor composition to be available for aerosolization in the specific area of the heater. A similar effect can be achieved such as through the use of particles or beads that can be sintered or otherwise interconnected to provide a continuous wick structure.

Filaments used in forming wicks can be provided singly or can be bundled (including meshes and braids). In other words, a filament can be a single fiber, or a filament can be formed of a group of combined fibers that provide a larger mass. Porosity of the filaments used in the wick also can be controlled to alter the capillary action and can include controlling average pore size and total porosity, controlling filament geometry, controlling overall wick shape, and controlling surface characteristics. Separate filaments also can have different lengths. Varying the nature of the filaments can be useful to customize vapor formation. For example, filaments with greater wicking ability can be used to transport a component of an aerosol precursor composition that is desired to be vaporized in a high amount, and filaments with a reduced wicking ability can be sued to transport a component of an aerosol precursor composition that is desired to be vaporized in a lesser amount.

The type of material used to form the individual filaments of the wicks also can be customized to transport specific types of compounds. For example, one or more wicks can be formed of filaments utilizing hydrophobic materials so as to preferentially wick hydrophobic liquids. Further, one or more wicks can be formed of filaments utilizing hydrophilic materials so as to preferentially wick hydrophilic liquids. Moreover, one or more wicks can include filaments formed of materials that are neither hydrophilic nor hydrophobic, such as natural materials, so as to preferentially wick liquids that are neither significantly polar nor significantly non-polar.

In particular embodiments, a wick useful as the liquid transport component is a braided wick. The braided wick can be formed from at least 3 separate fibers or yarns. Further, the braided wick can be formed from at least 4, at least 6, at least 8, at least 10, at least 12, at least 14, or at least 16 separate fibers or yarns. Each of the separate fibers or yarns may be identical in composition. Alternatively, the separate fibers or yarns may comprise fibers or yarns formed of two or more different compositions (e.g., a fiberglass yarn braided with a cotton yarn). Thus, the braided wick can be formed of a plurality of synthetic fibers or yarns, a plurality of natural fibers or yarns, of a combination of at least one synthetic fiber or yarn and at least one natural fiber or yarn. In certain embodiments, E-glass can be used. In preferred embodiments, C-glass can be used. Use of C-glass has been determined to be of particular use because of the higher solubility of the material in lung fluid compared to other materials, particularly other fiberglass materials.

A braided wick in particular may be provided as a component of a sheath/core yarn. In particular, a first wick material can form a yarn core, and a second wick material can surround the core to form a yarn sheath. The sheath and core can differ in at least one of physical structure and the material from which the yarn is formed. In a preferred example, a twisted yarn can comprise the core, and braided yarn can form the sheath.

An example of a sheath/core wick according to some embodiments of the present disclosure is shown in the cross-section of FIG. 5. As seen therein, a sheath/core wick 202 can be formed of a sheath component 203 and a core component 204. As illustrated, the sheath 203 is formed of braided fibers or yarn, as otherwise described herein. The core 204 is formed of a non-braided yarn. In various embodiments, the relative dimensions of the sheath/core wick cross-section can vary. The core may be in direct contact with the sheath, or a space may be provided between the sheath and the core.

A method of making an electronic smoking article is provided. The method includes the step of providing a cylinder comprising cellulose acetate and having a hollow interior portion. At least part of the hollow interior can be shaped and dimensioned to accommodate one or more further components of the smoking article. The method can further include the step of inserting an atomizer into the hollow interior of the cellulose acetate cylinder. The atomizer can comprise a liquid transport element, a heater, and electrical contacts. The method can further include the steps of inserting the cylinder and atomizer into a hollow shell, and connecting the atomizer to a power source. The power source can be a battery. Portions of the liquid transport element can be attached to or embedded in the reservoir to form a fluid connection that enables transport of the aerosol precursor composition out of the reservoir. The atomizer can comprise a continuous, elongated wick having two opposing ends. The wick particularly can be a braided wick and can comprise C-glass. The atomizer can further comprise a heater in connection with the wick and positioned at about a midpoint thereof. The atomizer also can comprise electrically conducting terminals positioned in physical contact with the wick and in electrical contact with the heater. According to one embodiment, the heater can be a resistive heating element. In some embodiments, the step of inserting the atomizer into the cellulose acetate cylinder can comprise extending a portion of the atomizer beyond an end of the cellulose acetate cylinder.

EXPERIMENTAL

The presently disclosed subject matter is more fully illustrated by the following examples, which are set forth to illustrate the presently disclosed subject matter and provide full disclosure, and they are not to be construed as limiting thereof.

Example 1

Preparation of Cellulose Acetate Reservoirs

Drylaid cellulose acetate (CA) substrates were constructed from conventional cigarette filter tow (Eastman Estron acetate tow, 3.0 dpf, 40,000 total denier, Y cross section) chopped to a staple length of 2.5 in. for evaluation of suitability for use as a reservoir according to the present disclosure. The sheet was mechanically entangled in a needlepunch process. There were no additional fibers or binders added to the sheet. Other CA fiber and tow sizes can be used, as well as various fiber cross sections, and staple lengths compatible with carding/needling. Needling at 500, 1000, and 1500 needle punches per square inch (NPPSI) all produced a usable sheet. The finished substrate sheets were produced from about 70 gsm to about 240 gsm, which yielded thicknesses from about 1 mm to about 4 mm. A preferred embodiment had a basis weight of 150 gsm at about 2 mm thickness and 1000 NPPSI. The lighter basis weight substrates resulted in greater amounts of aerosol generated from the product, all other factors being equal. These sheet parameters were chosen in part to accommodate the needs of the cartridge design and assembly process. They can be adjusted to match larger or smaller liquid loadings and/or physical cartridge size.

Hydroentangling was also tested as a method of entangling the staple fibers to create a cohesive sheet. Other methods such as stitch bonding, ultrasonic, or thermal bonding can also be used. Triacetin or other plasticizers, or a sprayed bonding agent might also be used. Mixtures of fibers can also be used to adjust the sheet properties with regard to liquid affinity, wicking, strength, elongation, and stiffness.

Wetlaid CA substrates were constructed from non-crimped CA yarns produced by Celanese and Eastman Chemical. The Eastman yarn was specified at 4.0 dpf and 150 total denier, regular (round) cross-section, with a conventional cigarette tow finish. The yarns were cut to 0.25 in. and 0.5 in. lengths for use in the wetlaid process. The 0.5 in. cut was preferred in the testing due to increased sheet integrity. Longer staple lengths may also improve this. Other filament deniers, total deniers, or cross-sections also can be used.

Several sheet compositions were tested. All compositions used a majority of CA fiber from about 75% to about 92% of the total dry weight. Additional fibers (singly or mixed) were added to strengthen the sheet from about 8% to about 25% of the total dry weight. These included: HP-11 wood pulp from Buckeye Technologies: DPL-2607, a PET (polyethylene terephthalate) bicomponent fiber, from Fiber Innovation Technologies; and Kuralon VPB 105-2×4, PVOH (polyvinyl alcohol) fiber from Kuraray Co., Ltd. The final material selected for production had a composition of 92% CA, 4% wood pulp, and 4% PVOH.

The finished substrate sheets were produced from about 70 gsm to about 160 gsm, with thicknesses from about 0.7 mm to about 3 mm. An exemplary material was about 115 gsm and about 1.5 mm thick. These sheet parameters were chosen in part to accommodate the needs of the cartridge design and assembly process. They can be adjusted to match larger or smaller liquid loadings and/or physical cartridge size. The substrate sheets were useful for formation into a hollow tube reservoir.

Other cellulosic fibers including rayon or cotton can be used in place of, or in addition to, wood pulp for substantially the same effect. Other methods of binding the sheet can include spray binders such as latex or solvent bonding with triacetin or other plasticizers.

An advantage to the wetlaid process is the ability to adjust fiber orientation to alter the "squareness" of the sheet. This works to reduce machine direction elongation, which in turn can improve the slit width uniformity.

Example 2

Improved Uptake and Release of Aerosol Precursor Composition

Reservoirs in known aerosolization devices typically have been formed of a nonwoven mat of polyester (PET) fibers. This has the advantage of being a relatively cheap and widely available material; however, it has been found that the hydrophobic nature of the material can lead to disadvantages, particularly when an aerosol precursor composition is formed primarily of hydrophilic materials. For example, PET nonwoven sheets promote little or no movement of the liquid precursor composition and can take on the order of several hours for full movement of a liquid precursor composition through the entire reservoir.

Experiments were conducted to evaluate cellulose acetate (CA) based substrates as reservoirs. A drylaid, nonwoven cellulose acetate reservoir (100% CA, 2.5 in. average fiber length, 150 gsm weight) was compared to a PET reservoir of like dimensions. FIG. 6 shows the two reservoirs one minute after placing the dry reservoirs on a liquid substrate comprising glycerin. FIG. 7 shows the reservoirs two minutes after placement. At one minute the CA tube had absorbed significant amounts of liquid while the PET had little to no absorption. At two minutes, the CA tube was saturated while the PET tube still had little to no absorption. This higher affinity for the liquid affects the product in multiple ways. For manufacturing, it allows rapid filling of the cartridge with the substrate absorbing liquid more readily and evenly. For product use, it permits the liquid in the cartridge to migrate more easily to the wick making more efficient use of the liquid in the cartridge.

The CA substrate was also tested against the PET substrate to evaluate filling times when used as a reservoir in a cartridge for a smoking article. The filling time for the PET substrate when applying liquid at the top of the substrate in the cartridge was greater than 30 minutes. The filling time under the same conditions for the CA substrate was less than two minutes.

With PET based substrates, it has been frequently observed at the end of product life that regions of the substrate not in contact with the wick are still saturated with liquid while the substrate in contact with the wick has become depleted. This is an inefficient system because more liquid must be put in the cartridge than can be effectively converted to aerosol. The images in FIG. 8 and FIG. 9 show a CA substrate before use (FIG. 8) and after use (FIG. 9). The figures show that when a CA reservoir is used in a smoking article, the applied aerosol precursor composition is depleted evenly throughout the reservoir. This advantageously can allow for the use of both a smaller reservoir and a smaller volume of aerosol precursor composition to achieve a desired number of puffs on a smoking article incorporating the CA reservoir. As seen in FIG. 10, aerosol forming efficiency increased as the size of the reservoir (saturated with aerosol precursor composition) decreased indicating that the aerosol precursor composition is efficiently and evenly transferred from the reservoir for aerosolization.

Example 3

Improved Uptake and Release of Liquid Transport Component

One of the major deficiencies identified with many known aerosolization smoking articles is the change in aerosol delivery over the life of the article. Most articles decline from 25% to 60% in aerosol delivery when comparing initial performance (e.g., puffs 1-20) to end-of-life performance (e.g., puffs 180-200). Ideally, the performance would be consistent over the life of the product. Testing was carried out to evaluate improving performance based on the nature of the liquid transport component (i.e., the wick) in the smoking article.

A comparative wick was formed of a twisted fiberglass yarn (9 micron E-glass) having a diameter of approximately 0.054 in. and a linear mass of about 2.15 mg/mm. The twisted yarn exhibited little cohesive structure, especially when cut to short lengths. The yarn was easily compressed which was considered a disadvantage for maintaining good contact with the resistive wire heater. When cut, the ends of the yarn were prone to blooming open as the tension or torsion imparted in the twisting process was released. This was expected to decrease the effectiveness of the wick for fluid transport.

In order to address these physical deficiencies, a braided fiberglass wick was developed at approximately the same specifications: 9-micron E-glass, 0.052 in. diameter, 2.47 mg/mm linear mass. This braided wick performed similarly to the original twisted wick. In both designs, the average mg of total particulate matter (TPM) per puff decreased by about 25% from the initial puffs to the end-of life puffs. This is illustrated in FIG. 11.

In a further test, a braided wick sheath was formed around a twisted core. The diameter and mass of the wick were also reduced. Three sheath/core wicks were formed with diameters of 0.043 in. to 0.047 in. and linear masses of 1.65 mg/mm to 1.85 mg/mm. The braided exterior of the sheath/core wicks were formed using 8 bobbins, 12 bobbins, and 16 bobbins, respectively, and thus were characterized as comprising 8, 12, or 16 braids. Each of the three sheath/core wicks provided a significantly higher TPM yield. See FIG. 12. The sheath/core wicks also exhibited smaller changes in TPM over the product life declining by about 20% in two cases. Compared to the original twisted wick, all of the braided designs exhibited greater physical integrity when cut with little unraveling or fraying. The braided designs were also firmer, potentially improving contact between the wire heater and the braid.

Many modifications and other embodiments of the disclosure will come to mind to one skilled in the art to which this disclosure pertains having the benefit of the teachings presented in the foregoing descriptions and the associated drawings. Therefore, it is to be understood that the disclosure is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. A method of providing an electronic smoking article with improved loading and release of a liquid aerosol precursor composition, the method comprising:

providing a fibrous reservoir formed of a cellulose acetate that has a basis weight of about 70 grams per square meter to about 240 grams per square meter;

positioning the fibrous reservoir and an atomizer including a liquid transport element inside of a cartridge shell such that the fibrous reservoir is substantially surrounding at least a portion of at least the liquid transport element; and adding a volume of a liquid aerosol precursor composition comprising a polyhydric alcohol to the fibrous reservoir within the cartridge shell;

wherein the fibrous reservoir formed of the cellulose acetate exhibits improved loading and release of the liquid aerosol precursor composition as evidenced by the fibrous reservoir formed of the cellulose acetate is being effective to substantially completely absorb the added volume of the liquid aerosol precursor composition in an amount of time that is reduced relative to a reservoir of like dimensions formed of a different fibrous material and being effective for providing substantially even depletion of the liquid aerosol precursor composition throughout the fibrous reservoir during use of the electronic smoking article.

2. The method of claim 1, wherein the reservoir is substantially shaped as a cylinder having a hollow interior portion.

3. The method of claim 1, wherein the atomizer comprises a heater and wherein the heater is optionally a resistive heating element.

4. The method of claim 3, wherein the liquid transport element is in the form of a continuous, elongated wick having two opposing ends and the heater is in connection with the wick and positioned at about a midpoint thereof.

5. The method of claim 4, further comprising electrically conducting terminals positioned in physical contact with the wick and in electrical connection with the heater.

6. The method of claim 1, wherein the liquid transport element is a continuous, elongated article adapted for wicking a liquid.

7. The method of claim 1, wherein the liquid transport element comprises a braided wick.

8. The method of claim 7, wherein the liquid transport element is in the form of a sheath/core wick.

9. The method of claim 8, wherein the sheath portion of the wick is braided.

10. The method of claim 9, wherein the core portion of the wick is non-braided or is formed of a different material than the braided sheath, or both.

11. The method of claim 7, wherein the braided wick is a braid of at least 4 separate fibers or yarns.

12. The method of claim 1, wherein the liquid transport element comprises fiberglass.

13. The method of claim 12, wherein the fiberglass is C-glass.

14. The method of claim 1, wherein the cellulose acetate is in the form of a fiber having a linear mass density of about 0.5 dpf or greater.

15. The method of claim 14, wherein the cellulose acetate is in the form of a fiber having a linear mass density of about 0.5 dpf to about 20 dpf.

16. The method of claim 1, wherein the fibrous reservoir formed of the cellulose acetate is effective to substantially completely absorb the added volume of the liquid aerosol precursor composition in an amount of time that is less than about 30 minutes.

17. The method of claim 1, wherein the fibrous reservoir formed of the cellulose acetate is effective to substantially completely absorb the added volume of the liquid aerosol precursor composition in an amount of time that is less than 2 minutes.

18. The method of claim 1, wherein the fibrous reservoir formed of the cellulose acetate such is effective to substantially completely absorb the added volume of the liquid aerosol precursor composition in an amount of time that is reduced relative to a reservoir of like dimensions formed of polyester fibers.

19. The method of claim 1, wherein the fibrous reservoir formed of the cellulose acetate has a basis weight of about 90 grams per square meter to about 200 grams per square meter.

20. The method of claim 1, wherein the fibrous reservoir formed of the cellulose acetate is provided in a form wherein the reservoir has been needle punched with at least 250 needle punches per square inch.

* * * * *